US007014967B2

(12) United States Patent
Miyamoto et al.

(10) Patent No.: US 7,014,967 B2
(45) **Date of Patent: *Mar. 21, 2006**

(54) IMAGE FORMING APPARATUS WITH ELECTROSTATIC CHARGER

(75) Inventors: Yuka Miyamoto, Shizuoka (JP); Toshiyuki Kabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/642,178

(22) Filed: Aug. 18, 2003

(65) Prior Publication Data

US 2004/0151997 A1 Aug. 5, 2004

(30) Foreign Application Priority Data

Aug. 19, 2002 (JP) ..... 2002-238393
Oct. 8, 2002 (JP) ..... 2002-295368

(51) Int. Cl.
*G03G 15/10* (2006.01)

(52) U.S. Cl. ..... 430/56; 399/159; 399/111

(58) Field of Classification Search ..... 430/56; 399/159, 111

See application file for complete search history.

(56) References Cited

U.S. PATENT DOCUMENTS 6,534,227 B1 * 3/2003 Kabata et al. ..... 430/30
6,641,964 B1 * 11/2003 Ikuno et al. ..... 430/66
6,649,313 B1 * 11/2003 Kabata et al. ..... 430/60
6,699,631 B1 * 3/2004 Miyamoto et al. ..... 430/56
6,844,124 B1 * 1/2005 Ikuno et al. ..... 430/58.7

* cited by examiner

*Primary Examiner*—John L. Goodrow
(74) *Attorney, Agent, or Firm*—Oblon, Spivak, McClelland, Maier & Neustadt, P.C.

(57) ABSTRACT

An image forming apparatus contains a photoconductor having a support and a photoconductive layer disposed thereon. I(S) at the surface of the photoconductor and I(S) at the interface of the photoconductive layer on the support side are $5.0\times10^{-3}$ or less and the sum of I(S)s is $3.0\times10^{-3}$ or more. I(S)s are determined according to following Equations 2 and 3 after subjecting a group of data of N samples of height×(t) [μm] of a profile curve at the surface or of one at the interface to discrete Fourier transform according to following Equation 1, the N samples being taken at intervals of Δt [μm] in a reference line direction $$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 1}$$

wherein n and m are each an integer; N is $2^{\rho}$, where ρ is an integer $$S\left(\frac{n}{N\cdot\Delta t}\right)=\frac{1}{N}\cdot\left|X\left(\frac{n}{N\cdot\Delta t}\right)\right|^2 \quad \text{Equation 2}$$

$$I(S)=\left(\frac{1}{N}\right)\sum_{n=0}^{N-1}\left\{S\left(\frac{n}{N\cdot\Delta t}\right)\right\}. \quad \text{Equation 3}$$

24 Claims, 5 Drawing Sheets

IMAGE FORMING APPARATUS WITH ELECTROSTATIC CHARGER

BACKGROUND OF THE INVENTION

1. Field of the Invention

The present invention relates to a photoconductor using laser light or other coherent light as a writing light, and to an image forming apparatus and a cartridge for an image forming apparatus using the photoconductor.

2. Description of the Related Art

An electrophotographic process by use of coherent light, such as laser light, as a writing light, is widely used for the formation of digital images such as in copying machines, printers and facsimile apparatus.

In an electrophotographic process using coherent light as a writing light, an image including light and shade stripes (hereinafter referred to as interference fringes) is formed due to the interference of the coherent light within a photoconductive layer of the photoconductor. Such light and shade stripes are generated by the writing light being intensified when the photoconductor satisfies the relationship of $2nd=m\lambda$ wherein n is the refractive index of a charge transporting layer at the wavelength of the writing light, d is the thickness of the charge transporting layer, $\lambda$ is the wavelength of the writing light, and m is an integer. More specifically, when $\lambda$ is 780 nm and n is 2.0, one set of light and shade stripes (interference fringes) appears at each change of 0.195 $\mu$m in the thickness of the charge transporting layer. In order to remove interference fringes completely, it is necessary to reduce the deviation of the thickness of the charge transporting layer to less than 0.195 $\mu$m in the entire image formation area. However, it is economically extremely difficult to produce a photoconductor with such a small deviation of the thickness of the charge transporting layer, so that various alternative techniques have been proposed to control or reduce the formation of interference fringes in images.

For example, Japanese Patent Application Laid-Open (JP-A) No. 57-165845 proposes a photoconductor comprising a support made of aluminum, a charge transporting layer formed on the support, a charge generating layer comprising amorphous silicon (a-Si) formed on the charge transporting layer, and further comprising a light absorption layer on the aluminum support to remove the mirror reflection of the aluminum support, thereby preventing the formation of interference fringes in images. The light absorption layer on the aluminum support is extremely effective for preventing the formation of interference fringes in the image with the photoconductor using the charge generating layer comprising a-Si with the layer structure of the aluminum support/charge transporting layer/charge generating layer as mentioned above. However, for an organic photoconductor with a layer structure of aluminum support/charge generating layer/charge transporting layer in general use, the provision of the light absorption layer on the aluminum support is not so effective for preventing the formation of interference fringes in the image.

JP-A No. 07-295269 discloses a photoconductor with a layer structure of aluminum support/undercoat layer/charge generating layer/charge transporting layer, with the provision of a light absorption layer on the aluminum support for preventing the formation of interference fringes in the image. However, the photoconductor with this layer structure cannot completely prevent the formation of interference fringes in the image.

Japanese Patent Application Publication (JP-B) No. 07-27262 discloses an image forming apparatus comprising a photoconductor and an optical system. The photoconductor comprises a cylindrical support which has such a convex cross section that is formed by superimposing a sub-peak on a main peak, when the cylindrical support is cut by a plane which includes the axis of the cylindrical support. The optical system uses a coherent light beam with a beam diameter which is less than one period of the main peak for exposure. In some photoconductors, the formation of interference fringes in the image can be controlled to some extent by use of the above-mentioned support. However, many photoconductors cannot prevent the formation of interference fringes in the image even though the above-mentioned support is used.

JP-A No. 10-301311 discloses a photoconductor including a photoconductive layer supported on a support, in which the center-line surface roughness Ry of the support is one half or more of the wavelength of the writing light beam so as to prevent the formation of interference fringes with respect to a writing light with a wavelength of 650 nm or more. The photoconductor may often reduce interference fringes when used in an image forming apparatus having a low resolution or having a relatively large spot diameter of writing light beam. However, when the spot diameter of the writing light beam is reduced so as to improve the resolution, interference fringes are unavoidably formed. The surface roughness Ry can properly represent magnitude of average unevenness of a profile curve composed of only waves with similar amplitudes. However, an actual profile curve of a photoconductor is composed of a multiplicity of waves of greatly different wavelengths and amplitudes. Minute waves superimposed on waves with large amplitudes are cancelled in calculating Ry and thus are not reflected in Ry at all. Ry is thereby no appropriate as a parameter for representing minute unevenness or roughness.

When an image forming apparatus with high resolution is used, even if the surface roughness of the support is defined by conventionally employed parameters such as maximum height (Rmax), and ten-point average roughness (Rz), there cannot be determined the conditions under which the formation of interference fringes can be completely prevented.

Photoconductors in which surface roughness of an intermediate layer and/or an outermost layer is specified are known.

For example, JP-A No. 2001-265014 discloses a photoconductor in which a profile curve at the interface of the photoconductive layer on the side of the support is specified according to Fourier analysis to avoid interference fringes. Specifying the profile curve according to Fourier analysis is very appropriate, and the photoconductor can substantially completely suppress the formation of interference fringes. However, when the photoconductor is used in an image forming apparatus having a photoconductor and an electrostatic charger arranged at a distance from the photoconductor of 100 $\mu$m or less, it often invites images with voids due to, for example, discharge breakdown. Such an image forming apparatus having a photoconductor and an electrostatic charger arranged close to the photoconductor is configured so as to reduce the formation of ozone, NOx, and other oxidizing substances upon electrification and is therefore environmentally friendly used.

JP-A No. 06-138685 discloses a photoconductor including a conductive support having a ten-point surface roughness Rz of 0.01 to 0.5 $\mu$m and a surface protective layer having an Rz of 0.2 to 1.2 $\mu$m. However, a surface protective layer is generally poor in hole transferring ability so that the photoconductor tends to cause an increase in electric potential of a latent image and to produce an unclear image by influences of, for example, ion species generated by electrification, oxidizing or reducing gas, and/or humidity. It is extremely difficult to specify an Rz to eliminate interference fringes completely. When the image forming apparatus has a high image writing resolution, image defects such as interference fringes tend to occur.

JP-A No. 07-13379 discloses a photoconductor including an intermediate layer and a surface protective layer for the purpose of preventing interference fringes such as moire. To prevent white voids in a solid pattern, the intermediate layer and the surface protective layer have specific ten-point surface roughness Rz of 1.0 $\mu$m or less. However, the Rz for each layer is not disclosed to be effective to prevent interference fringes such as moire.

JP-A No. 08-248663 discloses a photoconductor including a support having a surface roughness of 0.01 to 2.0 $\mu$m, and an outermost layer having a surface roughness of 0.1 to 0.5 $\mu$m and containing inorganic particles having an average particle diameter of 0.05 to 0.5 $\mu$m. However, it is not specified what kind of surface roughness is the surface roughness of the support and the outermost layer. As is described above, conventional parameters of surface roughness include Rmax, Rz and Ra. It is well known that measured surface roughness values obtained from a profile curve at the surface of a solid largely vary depending upon the parameters adopted and upon the measurement conditions such as measurement length. When the surface roughness of the support, and the surface roughness of the surface protective layer are specified as Rz defined in, for example, Japanese Industrial Standards (JIS), interference fringes occur in many cases, and such specifying cannot completely prevent such interference fringes. Moreover, even with a photoconductor having the same surface roughness, the degree of interference fringes varies depending upon the image writing resolution of the image forming apparatus.

The interference fringes can be prevented in many cases by roughening the surface of a support and/or a photoconductor, although means for reliably inhibiting image defects such as interference fringes has not yet been found. Moreover, even with the same photoconductor, the degree of interference fringes varies depending upon the resolution of the image forming apparatus, and the wavelength of the writing light. With the known techniques, it is impossible to produce images free of interference fringes while retaining other desired image qualities. It is also necessary to design, with a try-error technique, a desired photoconductor suited for a specific image forming device.

An excessively roughened surface of a photoconductor and/or of a conductive support may often invite white voids due to discharge breakdown, as described above. Accordingly, a demand has been made on an image forming technique that can inhibit both the interference fringes and discharge breakdown.

SUMMARY OF THE INVENTION

Under these circumstances, an object of the present invention is to provide a photoconductor free from images with interference fringes due to multiple reflection of coherent light in the photoconductor and free from voids in images due to discharge breakdown, and to provide an image forming apparatus and a cartridge for an image forming apparatus which use the photoconductor and can form high-quality images.

The present inventors have made intensive investigations on the principle of inhibiting interference fringes. They thought that when very minute interference fringes invisible with naked eyes are positively formed, the interference fringes are not visually recognized as a whole, and that interference fringes may be prevented when minute roughness is provided on a surface of a photoconductor. This is because such interference fringes cannot be completely avoided in an image forming apparatus using laser light and other coherent light as a writing light. Interference fringes of an image occur when the photoconductor has a specific thickness satisfying the relationship of $2nd=m\lambda$. The present inventors thought that when very minute interference fringes invisible with naked eyes are positively formed on the support of the photoconductor or at the interface of the photoconductive layer on the side of the support, the interference fringes are not visually recognized as a whole, and that interference fringes may be prevented when minute unevenness is provided on a surface of the photoconductor.

However, when various photoconductors having a roughened surface were measured for the surface roughness thereof using the conventional parameters of surface roughness such as Rz in order to specify whether or not the photoconductor in question invites interference fringes, these parameters showed substantially no difference or showed an inverted tendency among measured photoconductors. Surface roughness having an effect of preventing interference fringes was not able to be specified.

For the purpose of properly specifying surface conditions of a photoconductor to prevent interference fringes, the present inventors carefully observed profile curves of photoconductors and found that a profile curve of a surface of a photoconductor consists of a multiplicity of waves of different wavelengths and amplitudes and that waves having relatively small amplitudes as well as waves having large amplitudes largely influence the occurrence of interference fringes. Of the conventional parameters of surface roughness, Ry represents a difference in height between the highest peak and the deepest valley of a measured profile curve and cannot extract information of minute unevenness. Rz represents a difference between an average of the height of the five highest peaks and an average of the depth of the five deepest valleys and is frequently used as a parameter representing an average unevenness of a profile curve. However, when the number of waves constituting a profile curve is very large, the number of extracted waves is excessively small with the five highest peaks and the five deepest valleys, so that Rz cannot properly express the profile curve. Most of photoconductors free from the formation of interference fringes comprise a very large number of waves, and Rz cannot property represent the profile curve. Ra can properly represent magnitude of average unevenness of a profile curve composed of only waves with large amplitudes. However, minute waves superimposed on waves with large amplitudes are cancelled in calculating Ra and thus are not reflected in Ra at all. Ra cannot properly express a profile curve. As is described above, the conventional parameters express a profile curve focusing on waves with large amplitudes without any consideration of minute waves with small amplitudes and thus cannot specify surface conditions of a photoconductor to prevent interference fringes.

The present inventors has found that it is necessary to make all the waves constituting the profile curve of a photoconductor have a predetermined strength (power) or greater in order to attain such surface conditions of a photoconductor as to prevent interference fringes.

The fact that the strength of all the waves is strong means that the entire surface of the photoconductor is largely undulated, namely sufficiently roughened. Then, intervals between interference fringes in an image can be too small to be recognized with naked eyes.

However, when the surface of a photoconductor and/or the interface of a photoconductive layer on the side of a support is excessively roughened in an image forming apparatus comprising the photoconductor and an electrostatic charger arranged close to the photoconductor at a distance of 100 μm or less, images with voids may occur due to discharge breakdown. To avoid discharge breakdown, the surface and the interface are preferably not so roughened.

The present inventors have found that when minute unevenness is formed and is varied both on the surface of the photoconductor and at the interface of the photoconductive layer on the side of the support, the surface and interface are sufficiently roughened to prevent both interference fringes and discharge breakdown. They have made investigations on conditions for inhibiting both interference fringes and discharge breakdown when an image forming apparatus having a photoconductor and an electrostatic charger arranged close to the photoconductor at a distance of 100 μm or less. As a result, they have found that both interference fringes and image defects due to discharge breakdown can be prevented by minimizing the roughness of the surface of the photoconductor and the interface of the photoconductive layer on the side of the support within such ranges that interference fringes reliably occur within pixels. The present invention has been accomplished based on these findings.

The present invention can therefore solve the above problems.

Specifically, the present invention provides, in a first aspect, an image forming apparatus including a photoconductor containing a support, and at least a photoconductive layer disposed on the support; an electrostatic charger for uniformly charging the photoconductor, being arranged at a distance from the photoconductor of 100 μm or less; and a light-exposing device for irradiating a coherent light imagewisely to the photoconductor. In the apparatus, I(S) at the surface of the photoconductor and I(S) at the interface of the photoconductive layer on the side of the support are each $5.0\times10^{-3}$ or less, and the sum of I(S) at the surface of the photoconductor and I(S) at the interface of the photoconductive layer on the side of the support is $3.0\times10^{-3}$ or more, each I(S) is determined by subjecting a group of data of N samples of height×(t) [μm] of a profile curve at the surface of the photoconductor or of a profile curve at the interface of the photoconductive layer on the side of the support, to discrete Fourier transform according to following Equation 1, the N samples being taken at intervals of Δt [μm] in a reference line direction; and subjecting the resulting data to calculations according to following Equations 2 and 3.

$$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 1}$$

wherein n and m are each an integer; and N is $2^{\rho}$, where ρ is an integer.

$$S\left(\frac{n}{N\cdot\Delta t}\right)=\frac{1}{N}\cdot\left|X\left(\frac{n}{N\cdot\Delta t}\right)\right|^2 \quad \text{Equation 2}$$

$$I(S)=\left(\frac{1}{N}\right)\sum_{n=0}^{N-1}\left\{S\left(\frac{n}{N\cdot\Delta t}\right)\right\} \quad \text{Equation 3}$$

The sampling interval Δt is preferably from 0.01 to 50.00 μm and the sampling number N is preferably 2048 or more.

It is preferred that the photoconductor includes a conductive support and at least a photoconductive layer disposed on the support and has particles exposed from its surface.

The particles exposed from the surface of the photoconductor may have a primary particle diameter of from 0.01 to 1.0 μm.

The particles may be metallic oxide particles.

Preferred particles for use herein are aluminum oxide particles prepared by a gas phase process.

The surface of the photoconductor preferably includes a polycarbonate resin, a metallic oxide, and a charge transporting material.

The image forming apparatus having these configurations can form high-quality images free from image defects such as interference fringes and voids and can reduce the formation of harmful oxidizing substances.

The support of the photoconductor is preferably an unmachined drum or an unmachined belt.

Alternatively, the support of the photoconductor may be a drum machined with a flat cutting tool.

The image forming apparatus having these configurations can form high-quality images free from image defects such as interference fringes even using a photoconductor employing a low-cost support.

The image forming apparatus may be configured to produce an image with a resolution of 1000 dpi or higher.

The image forming apparatus may further include a device for applying a lubricant to the surface of the photoconductor.

Zinc stearate is preferably used as the lubricant.

The image forming apparatus may use a coherent light having a wavelength λ of 700 μm or less.

The image forming apparatus having these configurations can form high-quality images free from image defects such as interference fringes even though it can form images with a high resolution.

The image forming apparatus may be configured so as to output a plurality of writing light beams simultaneously to the photoconductor to thereby form images.

This image forming apparatus can form, even at a high speed, high-quality images free from image defects such as interference fringes.

The image forming apparatus may be configured so as to output a writing light imagewise to the photoconductor according to a multiple-valued tone reproduction system to thereby form an image.

The image forming apparatus just mentioned above can form high-quality and natural images free from image defects such as interference fringes.

The photoconductor may have a charge transporting layer having a thickness of 15 μm or less.

The image forming apparatus having this configuration can form high-quality images free from image defects such as interference fringes even though it can form images with high resolution.

The image forming apparatus may use a toner having an average particle diameter of 8 μm or less.

This image forming apparatus can form high-quality and fine images free from image defects such as interference fringes.

The apparatus just mentioned above may be configured to produce color images.

The color image forming apparatus having this configuration can form high-quality color images free from image defects such as interference fringes.

The image forming apparatus may include a plurality of photoconductors for forming a plurality of color toner images, respectively, an intermediate transfer member to receive the color toner images from respective photoconductors so that received toner images are superposed to form a color image, the intermediate transfer member being capable of transferring the color image to an output medium.

The color image forming apparatus just mentioned above can form high-quality color images free from image defects such as interference fringes regardless of the type of an output medium.

The intermediate transfer belt for use herein is preferably elastic.

The color image forming apparatus having this configuration can form high-quality color images free from image defects such as interference fringes and free from missing in images and dust in images.

The image forming apparatus just mentioned above may be configured so that the color toner image formed on the intermediate transfer belt has a maximum thickness of 30 μm or more.

The image forming apparatus having this configuration can form sharp and clear images.

The image forming apparatus may include a plurality of photoconductors for forming a plurality of color toner images, respectively, an intermediate transfer member to receive the color toner images from respective photoconductors to form stacked color toner images, and an image receiving medium to receive the stacked color toner images from the intermediate transfer member.

This color image forming apparatus can form, at a high speed, high-quality color images free from image defects such as interference fringes.

The present invention further provides, in another aspect, a photoconductor for the aforementioned image forming apparatus. The photoconductor includes a support, and at least a photoconductive layer arranged on the support, in which I(S) at the surface of the photoconductor and I(S) at the interface of the photoconductive layer on the side of the support are each $5.0\times10^{-3}$ or less, and the sum of I(S) at the surface of the photoconductor and I(S) at the interface of the photoconductive layer on the side of the support is $3.0\times10^{-3}$ or more, each I(S) is determined by subjecting a group of data of N samples of height×(t) [μm] of a profile curve at the surface of the photoconductor or of a profile curve at the interface of the photoconductive layer on the side of the support, to discrete Fourier transform according to following Equation 4, the N samples being taken at intervals of Δt [μm] in a reference line direction; and subjecting the resulting data to calculations according to following Equations 5 and 6.

$$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 4}$$

wherein n and m are each an integer; N is $2^{\rho}$, where ρ is an integer.

$$S\left(\frac{n}{N\cdot\Delta t}\right)=\frac{1}{N}\cdot\left|X\left(\frac{n}{N\cdot\Delta t}\right)\right|^2 \quad \text{Equation 5}$$

$$I(S)=\left(\frac{1}{N}\right)\sum_{n=0}^{N-1}\left\{S\left(\frac{n}{N\cdot\Delta t}\right)\right\} \quad \text{Equation 6}$$

The photoconductor can be used to constitute an image forming apparatus that can form high-quality images free from image defects such as interference fringes.

The present invention further provides, in yet another aspect, a cartridge for the aforementioned image forming apparatus. The cartridge includes at least a photoconductor including a support, and at least a photoconductive layer disposed on the support, in which I(S) at the surface of the photoconductor and I(S) at the interface of the photoconductive layer on the side of the support are each $5.0\times10^{-3}$ or less, and the sum of I(S) at the surface of the photoconductor and I(S) at the interface of the photoconductive layer on the side of the support is $3.0\times10^{-3}$ or more. Each I(S) is determined by subjecting a group of data of N samples of height×(t) [μm] of a profile curve at the surface of the photoconductor or of a profile curve at the interface of the photoconductive layer on the side of the support, to discrete Fourier transform according to following Equation 4, the N samples being taken at intervals of Δt [μm] in a reference line direction; and subjecting the resulting data to calculations according to following Equations 5 and 6.

$$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 4}$$

wherein n and m are each an integer; N is $2^{\rho}$, where ρ is an integer.

$$S\left(\frac{n}{N\cdot\Delta t}\right)=\frac{1}{N}\cdot\left|X\left(\frac{n}{N\cdot\Delta t}\right)\right|^2 \quad \text{Equation 5}$$

$$I(S)=\left(\frac{1}{N}\right)\sum_{n=0}^{N-1}\left\{S\left(\frac{n}{N\cdot\Delta t}\right)\right\} \quad \text{Equation 6}$$

The cartridge can be used to constitute an image forming apparatus that can form high-quality images free from image defects such as interference fringes.

Further objects, features and advantages of the present invention will become apparent from the following description of the preferred embodiments with reference to the attached drawings.

DETAILED DESCRIPTION OF THE PREFERRED EMBODIMENTS

The present invention will be illustrated in detail below.

An image forming apparatus according to the present invention comprises a photoconductor, an electrostatic charger for uniformly charging the photoconductor, and a light-exposing device for irradiating a writing a coherent light imagewisely to the photoconductor, in which the photoconductor comprises a support and at least a photoconductive layer disposed on the support, and the distance between the photoconductor and the electrostatic charger is 100 $\mu$m or less. In this image forming apparatus, I(S) at the surface of the photoconductor and I(S) at the interface of the photoconductive layer on the side of the support are each $5.0\times10^{-3}$ or less, and the sum of I(S) at the surface of the photoconductor and I(S) at the interface of the photoconductive layer on the side of the support is $3.0\times10^{-3}$ or more. Each I(S) is determined by subjecting a group of data of N samples of height×(t) [$\mu$m] of a profile curve at the surface of the photoconductor, or of a profile curve at the interface of the photoconductive layer on the side of the support, to discrete Fourier transform according to following Equation 13, the N samples being taken at intervals of $\Delta t$ [$\mu$m] in a reference line direction; and subjecting the resulting data to calculations according to following Equations 14 and 15.

$$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 13}$$

wherein n and m are each an integer; N is $2^{\rho}$, where $\rho$ is an integer.

$$S\left(\frac{n}{N\cdot\Delta t}\right)=\frac{1}{N}\cdot\left|X\left(\frac{n}{N\cdot\Delta t}\right)\right|^2 \quad \text{Equation 14}$$

$$I(S)=\left(\frac{1}{N}\right)\sum_{n=0}^{N-1}\left\{S\left(\frac{n}{N\cdot\Delta t}\right)\right\} \quad \text{Equation 15}$$

In the above equations, t is a sampling length in a reference line direction between the reference point and the sampling point of the profile curve. The height×(t) of the profile curve is a relative amount with reference to an arbitrary base such as a height at the initial point at the start of the measurement or a height at the midpoint (t/2) of the sampling length t of the profile curve.

The term "reference line direction" as used herein means a direction of an intersection between a plane of the surface to be measured (the surface of the photoconductor or the interface of the photoconductive layer on the side of the support) and a plane in which the surface is cut for obtaining the profile curve of the surface, assuming that there is no unevenness on the plane to be measured. In other words, when the surface of the photoconductor, assuming that there is no unevenness, is placed in a horizontal plane, the "reference line direction" is a horizontal direction, i.e., a direction of a line in the horizontal plane.

Figure 1:
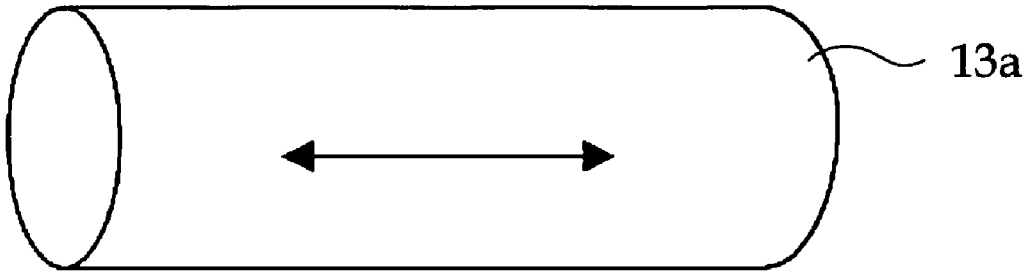
FIG. 1 is an illustration of a preferred sampling direction in a photoconductor drum.
Figure 2:
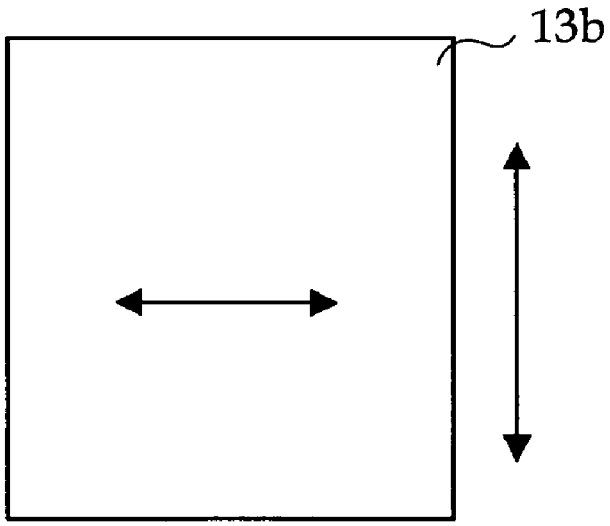
FIG. 2 is an illustration of a preferred sampling direction in a photoconductor belt or sheet.

Samples can be fundamentally taken in any arbitrary direction and is generally preferably taken in a main scanning direction or a subscanning direction of writing light for image formation. For example, the sampling direction is preferably a reference line direction (lengthwise direction) when the photoconductor is a drum 13*a*, as shown in FIG. 1. It is preferably a direction perpendicular to a moving direction of the photoconductor when the photoconductor is a belt or a sheet 13*b*, as shown in FIG. 2.

In the image forming apparatus of the present invention, I(S) at the surface of the photoconductor is $5.0\times10^{-3}$ or less, I(S) at the interface of the photoconductive layer on the side of the support is $5.0\times10^{-3}$ or less, and the total of I(S) at the surface of the photoconductor and I(S) at the interface of the photoconductive layer on the side of the support is $3.0\times10^{-3}$ or more. Thus, interference fringes that can be recognized by naked eyes can be suppressed as a whole, and images with voids due to discharge breakdown can be inhibited. The I(S) at the surface of the photoconductor and I(S) at the interface of the photoconductive layer on the side of the support should each be $5.0\times10^{-3}$ or less and are preferably $4.0\times10^{-3}$ or less, and more preferably $3.0\times10^{-3}$ or less. If they exceed $5.0\times10^{-3}$, black voids or spots due to discharge breakdown tend to occur, although interference fringes can be prevented.

The total of I(S) at the surface of the photoconductor and I(S) at the interface of the photoconductive layer on the side of the support should be $3.0\times10^{-3}$ or more and is preferably $3.5\times10^{-3}$ or more, and more preferably $4.0\times10^{-3}$ or more. If the total of I(S)s is less than $3.0\times10^{-3}$, the energy of the waves of the entire surface is so weak that interference fringes have broader intervals and tend to be conspicuous in a printed image as image defects.

When the length of the profile curve of the photoconductor surface in a horizontal direction is designated as t [$\mu$m], the height (amplitude)×(t) [$\mu$m] of the curve is an irregular fluctuation quantity. Any irregular fluctuation can be obtained by combining sinusoidal fluctuations with various frequencies with proper phase and amplitude. Namely, it can be expressed by Fourier transform according to the following equations.

$$x(t) = \int_{-\infty}^{\infty} X(k)\exp(i2\pi kt)dk \quad \text{Equation 16}$$

$$X(k) = \int_{-\infty}^{\infty} x(t)\exp(-i2\pi kt)dt \quad \text{Equation 17}$$

wherein k is a wave number [$\mu$m; the number of waves per micrometer]; a Fourier component X(k) represents a wave number k [namely, an amplitude of a wave with a wave length $\lambda$=1/k [$\mu$m]] included in the irregular fluctuation quantity×(t); and $|X(k)|^2$ represents energy of a component wave with a wave number k.

Distribution relation (spectrum) between the wave number k and the energy $|X(k)|^2$ of a component wave having the wave number k will be considered.

$$S(k) = \lim_{T\to\infty}\left[\frac{1}{T}|X(k)|^2\right] \quad \text{Equation 18}$$

wherein S(k) is an average energy of the component wave having a wave number k of a profile curve per unit section [1 $\mu$m], and defined as a power spectrum.

In practice, however, the height×(t) of the profile curve cannot be defined in a region of $-\infty<t<\infty$ but the measurement thereof is conducted in a part of a profile curve, namely in a region of $-T/2\leqq t\leqq T/2$, wherein T is a length of the measured section. Thus, when the S(k) is calculated not by taking the limit as $T\to\infty$ but from following Equation 19 using a T which is sufficiently large to such an extent that an average with respect to a wavelength of 1/k has a meaning as a microscope physical quantity, the result is substantially the same as the value obtained by taking the limit as $T\to\infty$.

$$S(k) = \frac{1}{T}|X(k)|^2 \quad \text{Equation 19}$$

As the Fourier transform employed herein is a discrete Fourier transform, the following alternation is conducted.

$$X\left(\frac{n}{N\cdot\Delta t}\right) = \sum_{m=0}^{N-1} x(m\cdot\Delta t)\exp\left(-i2\pi\cdot\frac{n}{N\cdot\Delta t}\cdot m\cdot\Delta t\right) \quad \text{Equation 20}$$

wherein n and m are each an integer; N is the number of sampled points and is an integer represented by $N=2^{\rho}$; and $\Delta t$ [$\mu$m] is a sampling interval and has a relation represented by $T/\Delta t=N$.

When the measuring length T of the profile curve is excessively short, the number of waves involved in the transform is so small that the error may be large or waves to exist may fail to be evaluated. The measuring range T can be properly determined according to the values of $\Delta t$ and N. In the photoconductor for use in the image forming apparatus of the present invention, $\Delta t$ is generally 0.01 to 50.00 $\mu$m, preferably 0.05 to 40.00 $\mu$m, and more preferably 0.10 to 30.00 $\mu$m. The smaller $\Delta t$ is, the more accurately the profile curve can be reproduced assuming that the sampling number N is infinite. However, when $\Delta t$ is less than 0.01 $\mu$m, a huge number of sampling points are necessary to make the measuring range T sufficiently large so that all the waves constituting the profile curve may be sampled. This increases the burden of calculation and results in decrease of the measuring range T and in increase of the error. If $\Delta t$ exceeds 50 $\mu$m, a large number of waves that are concerned with the characteristics of the photoconductor may not be extracted.

The more the sampling number N, the better, if the burden of calculation is not taken into consideration. Practically, it is 2048 or more, preferably 4096 or more, more preferably 8192 or more in order to decrease the error.

The calculation of a power spectrum is carried out on combinations of the sampling number N and the sampling interval $\Delta t$ in the surface of photoconductor for use in the image forming apparatus of the present invention. It has been confirmed that when the sampling interval $\Delta t$ is, for example, 0.31 [$\mu$m] as used in the examples according to the present invention, the power spectrum sufficiently converges when N is 4096.

Specifically, the calculation of a power spectrum using the discrete Fourier transform is carried out according to the following equation.

$$S\left(\frac{n}{N\cdot\Delta t}\right) = \frac{1}{N}\cdot\left|X\left(\frac{n}{N\cdot\Delta t}\right)\right|^2 \quad \text{Equation 21}$$

An integral value represented by following Equation 22 represents a total energy of the measured profile curve. However, the value varies depending upon measurement conditions. Thus, I(S) standardized by N can be employed as a universal parameter. Namely, I(S) can be calculated from following Equation 23:

$$\sum_{n=0}^{N-1}\left\{S\left(\frac{n}{N\cdot\Delta t}\right)\right\} \quad \text{Equation 22}$$

$$I(S) = \left(\frac{1}{N}\right)\sum_{n=0}^{N-1}\left\{S\left(\frac{n}{N\cdot\Delta t}\right)\right\} \quad \text{Equation 23}$$

It has been confirmed that the integral value also converges within a few percent error when N=4096 and $\Delta t$=0.31 [$\mu$m].

From a different point of view, a sampling interval for surface roughness of a photoconductor (real space) is $\Delta t$ [$\mu$m], while a sampling interval for power spectrum (inverse space) is $\Delta n=1/(N\ldots\Delta t)$ [$\mu m^{-1}$]. This is because the domain of the height×(t) of the profile curve is for a section $T=N\times\Delta t$. This means that the original signal×(t) is reproduced by a Fourier spectrum of sample values obtained in the inverse space at an interval of $\Delta t=1/(N\ldots\Delta t)$. The variation period of a profile curve which can be reproduced herein is about $2\Delta t$, [according to Shannon's sampling theorem]. As for the phenomenon examined now, surface roughness over this degree is involved, so that the sampling interval $\Delta t$=0.31 $\mu$m is sufficient. In some cases, however, variations with shorter periods must be taken into consideration. In such a case, the sampling intervals should be shorter as appropriate.

The profile curves at the surface of the photoconductor and the interface of the photoconductive layer on the side of the support can be measured by any method, as long as it has high reproducibility, high measurement accuracy and simplicity. Such methods include, for example, an optical method, an electrical method, an electrochemical method, and a physical method. Among them, an optical method or physical method is preferred because of the simplicity thereof, and especially, a physical method using a tracer is preferred most because of its high reproducibility and measurement accuracy.

In the image forming apparatus of the present invention, the distance between the photoconductor and the electrostatic charger is 100 μm or less, preferably 60 μm or less, and more preferably 30 μm or less. The lower limit thereof is 0 μm, namely, the two components are in contact with each other. If the distance between the photoconductor and the electrostatic charger exceeds 100 μm, ozone, NOx, and other oxidizing substances are significantly formed and cause environmental pollution, and the apparatus requires an extra device for removing these oxidizing substances.

The photoconductor for use in the image forming apparatus of the present invention comprises a support such as a conductive support, and at least a photoconductive layer arranged on the support. Where necessary, the photoconductor may further comprise an undercoat layer between the support and the photoconductive layer. The photoconductive layer can be a multilayer in which a charge generating layer and a charge transporting layer sequentially stacked or a single layer integrally comprising a charge generating layer and a charge transporting layer as a single unit. When the photoconductor is a single layer, the refractive index of the single layer is used as the refractive index n of the charge transporting layer.

Methods for controlling the surface condition of the photoconductor of the present invention include physical processing such as processing with an abrasive, an abrasive paper (tape), a grinder (a buffing machine or a sand blast); chemical or electrochemical surface roughening; surface roughening utilizing heat, such as heat ray irradiation, pressing of a heated photoconductor onto a mold having a roughened surface or pressing a heated mold having a roughened surface onto a photoconductor; a method in which the conditions at the time of producing the photoconductor, such as temperature and humidity, are controlled; and a method in which a layer containing particles is formed such that the particles are exposed from the surface thereof. Above all, a mechanical or physical processing method and a method in which particles are exposed from the photoconductor surface are preferred for higher productivity and reproducibility. Especially, the method in which particles are exposed from the photoconductor surface can accomplish a properly roughened, ideal surface condition without image defects such as interference fringes.

The particles for use in this method generally have a diameter of 0.01 to 1.00 μm, preferably 0.05 to 0.80 μm, more preferably 0.10 to 0.60 μm. A diameter of 1.00 μm or less is desirable for reasons of prevention of undulation of the photoconductor surface and occurrence of white voids and non-uniformity in a printed image and discharge breakdown. A diameter of 0.01 μm or more is desirable for reasons of attaining proper roughness of the photoconductor surface the prevention of interference fringes.

The particles contained in the surface layer of the photoconductor preferably have a refractive index 0.8 to 1.2 times, more preferably 0.85 to 1.15 times that of the charge transporting layer for reasons of good resolution of printed images. If the refractive index is significantly out of this range, the refraction of the writing light passing through the particles is significantly different from that in a region where no particles are present, thus causing decreased image writing resolution.

Particles which hardly absorb writing light are preferably used. Examples of such particles include particles of fluororesins (e.g. polytetrafluoroethylenes), silicone resins, phenol resins, carbonate resins, and other organic polymers; particles of above resins to which a charge transporting function is imparted; and particles of metal oxides, glass, i-carbon (diamond like carbon) and diamond. Among them, particles of metal oxides such as titanium oxide, aluminum oxide, silicone oxide, tin oxide, iron oxide and zirconium oxide are preferred because these can appropriately realize a surface condition suitable for the photoconductor of the present invention. Above all, aluminum oxide is preferred because it has a refractive index which is close to that of a charge transporting layer and is chemically stable. Especially, α aluminum oxide is most preferable because it can impart strength to the surface of the photoconductor.

Since aluminum oxide may be easily colored with a small amount of impurity and colored aluminum oxide may absorb writing light or may be lowered in hardness, aluminum oxide for use in the present invention has a purity of 3N (three nines) or more, preferably 4N (four nines) or more, and more preferably 5N (five nines) or more.

Although the particles may be applied onto a surface of a photoconductor by either a dry method or a wet method, a wet method is preferred, which is excellent in mass-productivity and with which the surface condition of the photoconductor can be easily controlled. Thus, the particles can be applied by a method comprising steps of applying a resin solution containing the particles to a surface of the photoconductor and removing the solvent from the resin solution. The application of the resin solution may be performed by any conventional technique such as dip coating, ring coating, roll coating, die coating, blade coating or spray coating. Above all, spray coating, in which the coating liquid adheres in the form of droplets and the droplets are combined to form a film, is preferred for the purpose of achieving the condition of the photoconductor surface as specified in the present invention.

The resin solution containing particles for use in application of the particles is not specifically limited as long as it has film forming properties and is capable of yielding a film having sufficient strength. It is preferred that the resin solution forms a film having hole transferring ability for reasons of prevention of an increase of a potential of a latent image. A coating liquid for forming a charge transporting layer is more preferably used as the resin resolution.

The resin solution desirably contains a thickening agent or a thixotropic agent because metal oxide particles generally have a larger specific gravity than the resin resolution. When the resin solution contains a charge transporting material, a small amount of an acceptor material such as a weak acid may be added thereto for imparting thixotropy to the resin resolution and improving the dispersibility of the particles and the hole transferring ability of the film. Thus, an increase of the potential of a latent image can be prevented.

Polymer donors as shown below have high abrasion resistance and high hole transferring ability and are preferably used.

Compound A
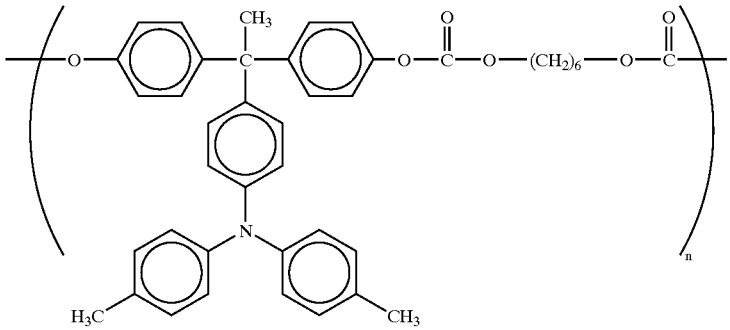
Compound B
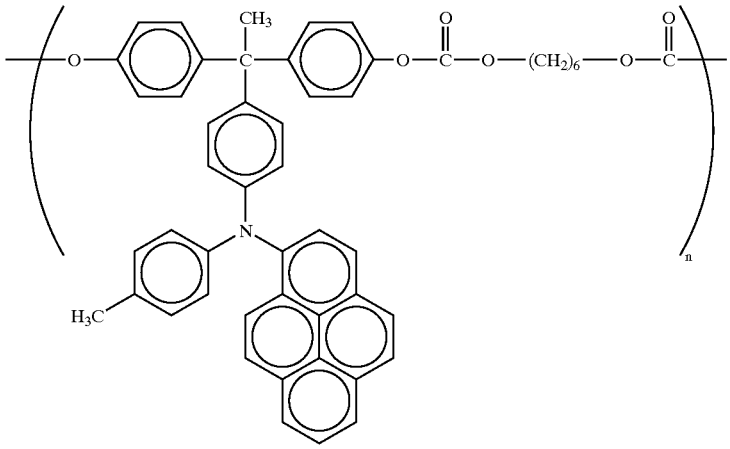
Compound C
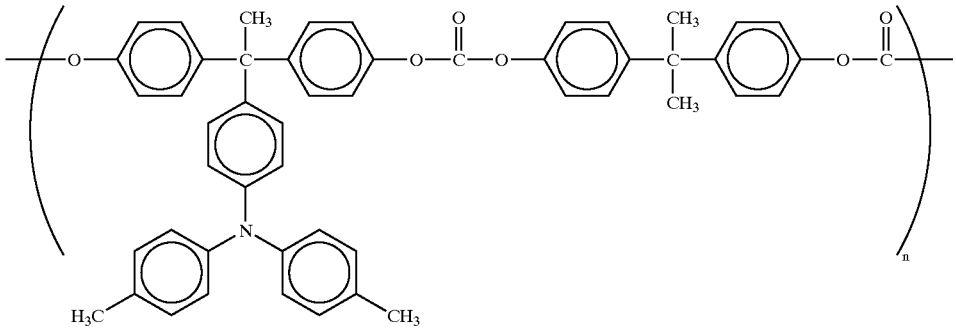
Compound D
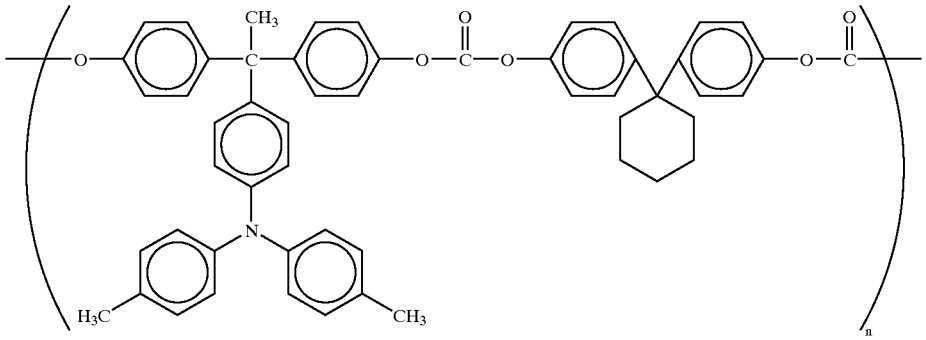

-continued

Compound E

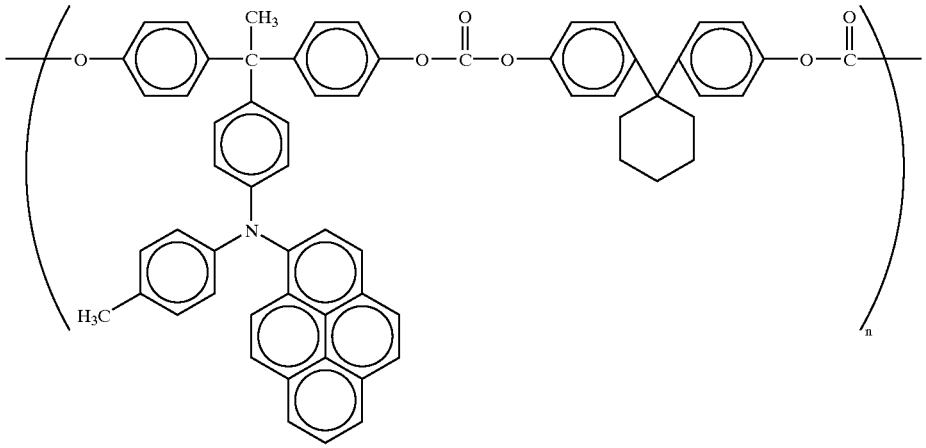

When the photoconductor comprises an undercoat layer, the profile curve at the surface of the undercoat layer can be used instead of the profile curve at the interface of the photoconductive layer on the side of the support, unless the undercoat layer swells or is dissolved upon the formation of the photoconductive layer. When the photoconductor does not comprise an undercoat layer, the profile curve at the surface of the support can be used instead of the profile curve at the interface of the photoconductive layer on the side of the support, unless the support swells or is dissolved upon the formation of the photoconductive layer.

The refractive index n of the charge transporting layer in the photoconductor varies depending on materials and production method of the charge transporting layer and also depending on the wavelength of the writing light. The refractive index n in the photoconductor of the present invention is generally in the range of 1.2 to 3.0, preferably 1.3 to 2.5, more preferably 1.4 to 2.2, for reasons of formation of a sharp latent electrostatic image and satisfactory sensitivity of the photoconductor.

The number of the writing light beam may be one (single-beam) or plural (multi-beam). The image forming apparatus of the present invention is particularly effective in multi-beam image writing for higher image forming speed. When writing light beam comprises plural beams, ends of spots of individual writing light beams may often overlap with each other and may invite image defects such as interference fringes unless the photoconductor surface is held under proper conditions as in the image forming apparatus of the present invention.

The support of the photoconductor of the present invention may be a drum or a belt of a metal such as copper, aluminum, gold, silver, platinum, iron, palladium, nickel or an alloy thereof or a composite belt having a plastic sheet on which a layer of a metal, such as those described above, or a metal oxide, such as tin oxide or indium oxide, is provided by vacuum deposition or electroless plating.

The surface of the support may be roughened by blasting or cutting. The image forming apparatus of the present invention does not invite image defects of interference fringes even in this case. The image forming apparatus is specifically preferably applied to the case in which the support is an unmachined drum or belt, or a drum machined with a flat cutting tool. These drums and belts may often invite interference fringes for no or little roughness (unevenness) of the surface of the support, although they can be produced at low cost. However, the image forming apparatus of the present invention does not invite interference fringes even when using such a photoconductor.

The undercoat layer of the photoconductor may be a resin layer, a layer mainly comprising a white pigment and a resin, or a metal oxide film obtained by chemically or electrically oxidizing a surface of a conductive support. Among them, a composition mainly comprising a white pigment and a resin is preferred. Examples of the white pigment include metal oxides such as titanium oxide, aluminum oxide, zirconium oxide and zinc oxide. Above all, titanium oxide, which is excellent in preventing injection of electrical charge from a conductive support, is most preferred. Examples of the resin for use in the undercoat layer include thermoplastic resins such as polyamides, poly(vinyl alcohol)s, casein, methylcellulose; and thermosetting resins such as acrylic resins, phenol resins, melamine resins, alkyd resins, unsaturated polyester resins and epoxy resins. Each of these resins can be used alone or in combination.

Examples of charge generating materials for use in the photoconductor include organic pigments and dyes such as mono azo pigments, bis azo pigments, tris azo pigments, tetrakis azo pigments, triarylmethane dyes, thiazine dyes, oxazine dyes, xanthene dyes, cyanine dyes, styryl dyes, pyrylium dyes, quinacridone pigments, indigo pigments, perylene pigments, polycyclic quinone pigments, bisbenzimidazole pigments, indanthrone pigments (indanthrene dyes), squalirium pigments, phthalocyanine pigments; and inorganic materials such as selenium, selenium-arsenic, selenium-tellurium, cadmium sulfide, zinc oxide, titanium oxide, amorphous silicon. Each of these charge generating materials can be used alone or in combination to form a charge generating layer together with a binder resin.

Examples of charge transporting material include anthracene derivatives, pyrene derivatives, carbazole derivatives, tetrazole derivatives, metallocene derivatives, phenothiazine derivatives, pyrazoline compounds, hydrazone compounds, styryl compounds, styrylhydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives. Each of these charge transporting materials can be used alone or in combination.

As a binder resin for use in formation of the charge generating layer and the charge transferring layer, any known thermoplastic resin, thermosetting resin, light-curable resin or photoconductive resin can be used as long as it is electrically nonconductive. Examples of the binder resin include, but are not limited to, thermoplastic resins such as poly(vinyl chloride)s, poly(vinylidene chloride)s, vinyl chloride-vinyl acetate copolymers, vinyl chloride-vinyl acetate-maleic anhydride terpolymers, ethylene-vinyl acetate copolymers, poly(vinyl butyral)s, poly(vinyl acetal)s, polyester resins, phenoxy resins, (meth)acrylic resins, polystyrenes, polycarbonates, polyallylates, polysulfones, polyethersulfones, and ABS (acrylonitrile-styrene-butadiene) resins; thermosetting resins such as phenol resins, epoxy resins, urethane resins, melamine resins, isocyanate resins, alkyd resins, silicone resins, thermosetting acrylic resins; and photoconductive resins such as polyvinylcarbazoles, polyvinylanthracenes, polyvinylpyrenes. Each of these binder resins can be used alone or in combination.

The image forming apparatus of the present invention does not invite image defects with interference fringes due to interference of writing light and can thereby be used as an image forming apparatus in, for example, copying machines, printers, and facsimile machines.

The photoconductor as a single part may be incorporated into the image forming apparatus of the present invention. Alternatively, at least one of a charging means, a development means, and a cleaning means may be incorporated in a process cartridge together with the photoconductor. To be more specific, the process cartridge is a single part or device which integrally has the photoconductor and at least one of the charging device, development device, and cleaning device and which is detachably set in the image forming apparatus. Use of the process cartridge simplifies maintenance and replacement operations of such an image forming unit.

Examples of the method for maintaining the initial condition of the photoconductor surface even after repeating image forming procedures include a method in which particles are exposed from the photoconductor surface and a method in which a protective layer is provided on the photoconductor surface to thereby improve the abrasion resistance of the photoconductor. An image forming method without a cleaning blade such as in a cleaner-less system and an image forming method in which image forming is conducted while a lubricant is applied onto the photoconductor surface are also effective. Especially, the method in which particles are exposed from the photoconductor surface and the method in which image forming is conducted while a lubricant is applied onto the photoconductor surface, or a combination thereof are preferred. The resulting photoconductor can maintain its initial good condition and the apparatus can form high-quality images even after repeating image forming procedures.

The I(S) of the profile curve of the photoconductor surface can be maintained within a range specified in the present invention, for example, by a method in which the photoconductor surface is forcibly ground with a blade or a brush to control the surface condition.

As the lubricant for use in the method in which image forming is conducted while a lubricant is applied onto the photoconductor surface, a material which hardly absorbs writing light and easily becomes fine powder or forms a film so as not to interfere with image forming is preferably used. Examples of the lubricant include fluororesins such as polytetrafluoroethylenes, poly(vinylidene fluoride)s, and metallic soups of salts of a higher fatty acid with a metal such as zinc and aluminum other than alkali metals. To maintain the condition of the photoconductor surface easily, metallic soaps are preferred and, especially, zinc stearate is preferred because it is relatively easy to apply onto the photoconductor surface in the shape of a film of fine particles.

The image forming apparatus of the present invention will be illustrated in further detail with reference to the attached drawings.

Figure 3:
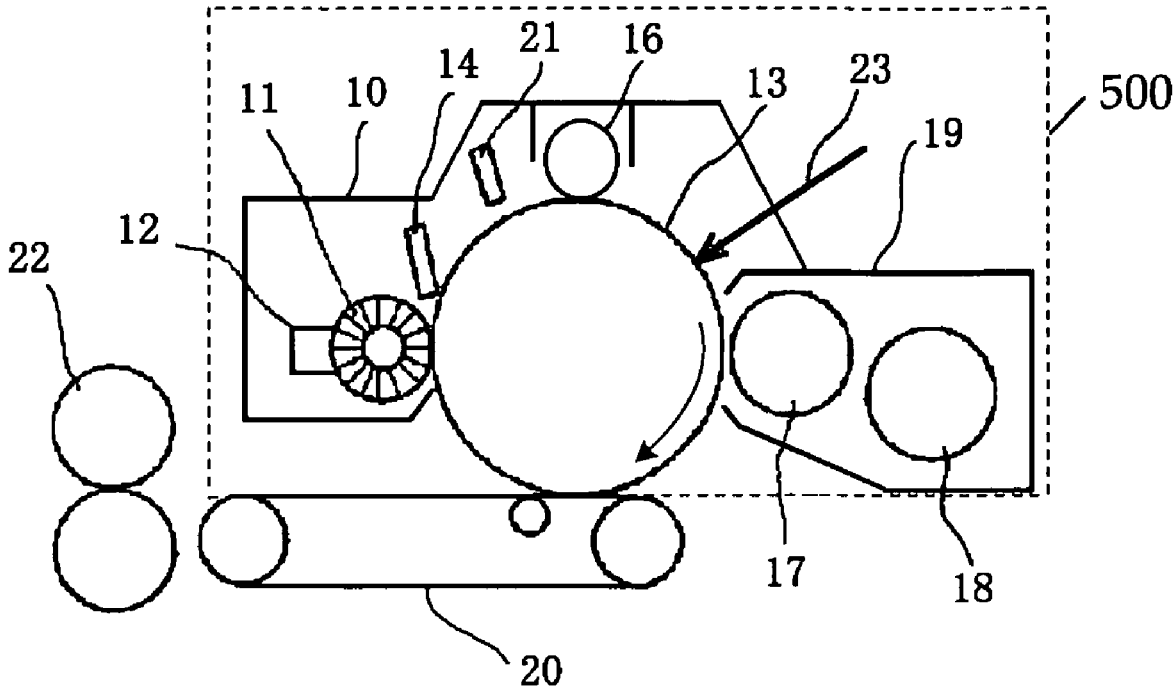
FIG. 3 is a schematic view of an example of an image forming apparatus according to the present invention.

FIG. 3 shows an example of an image forming apparatus of the present invention, in which a solid lubricant zinc stearate is used as a lubricant. Initially, the schematic configuration of the image forming apparatus and a process cartridge 500 will be illustrated. With reference to FIG. 3, a surface of a photoconductor 13 is uniformly charged by an electrostatic charger 16 while the photoconductor 13 is rotated in the direction of the arrow. Then, the photoconductor 13 is irradiated with image light 23 by light-exposing means (not shown) at an exposure section arranged downstream of the electrostatic charger 16. Thereby, electric charges at portions where the image light 23 was irradiated are lost and a latent electrostatic image corresponding to the image light 23 is formed on the surface of the photoconductor 13.

At a downstream of the exposure section, a development unit 19 as developing means is arranged and a toner as a developer is contained in the development unit 19. The toner is agitated and triboelectrified to desired polarity by an agitator 18 and is then transported to a nip part (development area) between a development roller 17 and the photoconductor 13 by the development roller 17. The toner transported to the development area is transferred from the surface of the development roller 17 to the surface of the photoconductor 13 by developing electric field formed in the developing area by developing bias applying means (not shown) and adheres to the surface of the photoconductor 13 to develop the latent electrostatic image on the photoconductor 13 into a toner image (visible image).

The toner image formed on the photoconductor 13 is transferred to a transfer paper as a transfer member. The transfer paper has been fed to a transfer section by paper supply means (not shown) by a nip part (transfer section) between a transfer-transport belt 20 as transferring means arranged in the vicinity of the photoconductor 13 and the photoconductor 13. The toner image formed on the transfer paper is fixed by a fixing roller 22 as fixing means disposed downstream of the rotating direction of the transfer-transport belt 20. Then, the transfer paper is ejected onto a paper output tray outside the apparatus body by delivering means (not shown).

Toner which is not transferred to the transfer paper at the transfer section and remained on the photoconductor 13 (residual toner) is removed from the photoconductor 13 by a cleaning brush 11 and a cleaning blade 14 of a cleaning unit 10 as cleaning means disposed downstream of the rotating direction of the photoconductor 13 in the transfer section. Residual electrostatic charge remained on the photoconductor 13 after the cleaning of the residual toner is eliminated by a charge eliminator 21 comprising, for example, a charge eliminating lamp.

Figure 4:
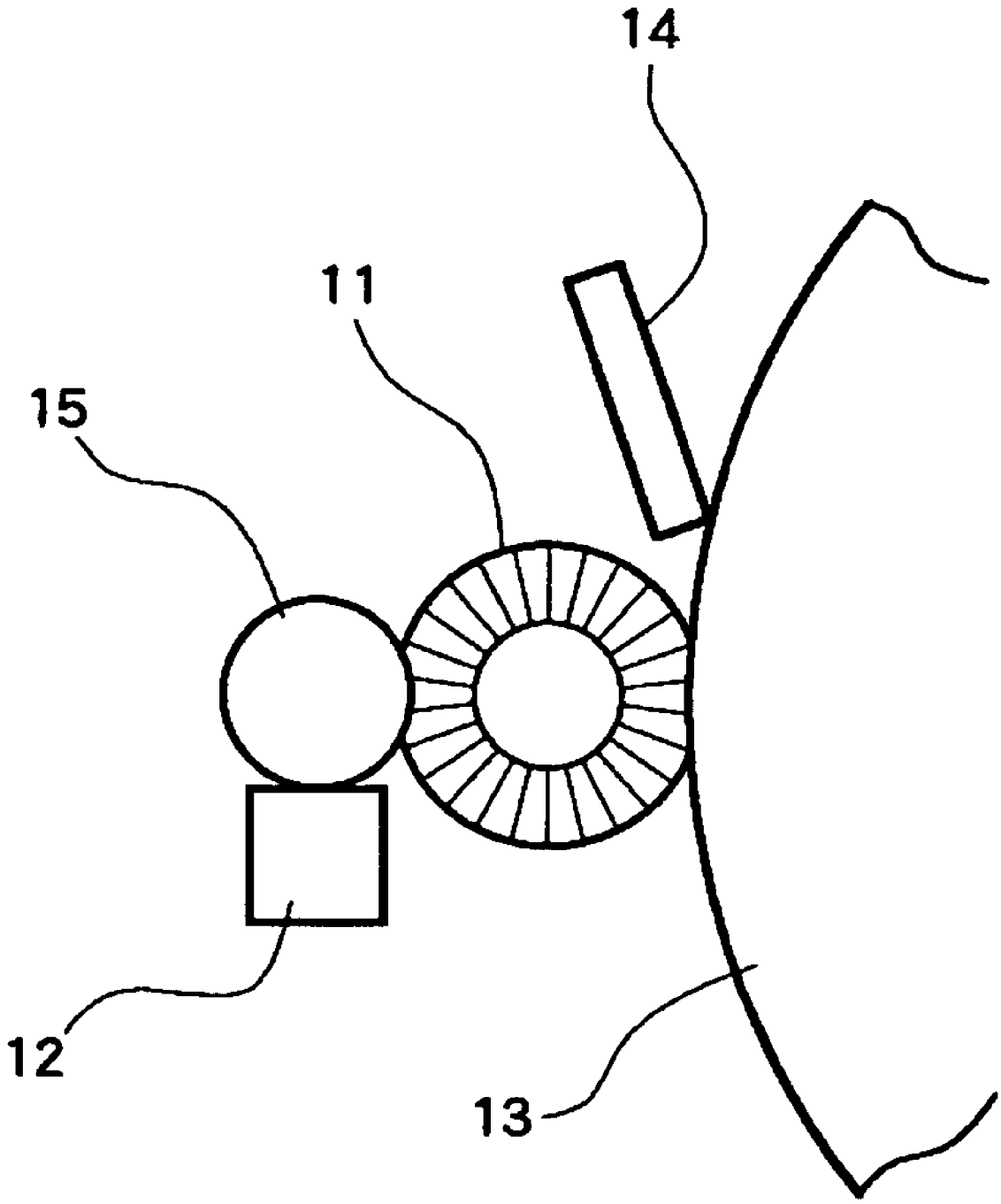
FIG. 4 is a schematic view of another example of an image forming apparatus according to the present invention, in which the apparatus further includes a device for applying a lubricant to the surface of a photoconductor.

In such an image forming apparatus, it is effective to utilize the cleaning brush 11 of the cleaning unit 10 as a zinc stearate applicator for applying zinc stearate to the surface of the photoconductor 13 in order to prevent enlargement of the apparatus and an increase in cost by providing the zinc stearate applying means. In the image forming apparatus according to the present embodiment, a solid lubricant 12 of zinc stearate is arranged in contact with the cleaning brush 11 of the cleaning unit 10 so that the zinc stearate may be applied to the surface of the photoconductor 13 by the cleaning brush 11. In the example shown in FIG. 3, the solid lubricant 12 is arranged in direct contact with the cleaning brush 11. However, as shown in FIG. 4, the zinc stearate as the solid lubricant may be disposed in contact with an outer surface of a coating roller 15 disposed in contact with the cleaning brush 11 so that the zinc stearate may be supplied to the cleaning brush 11 via the coating roller 15.

In this image forming apparatus, a composition obtained by fusing and solidifying materials containing zinc stearate as a main component is used as a solid lubricant 12. The solid lubricant 12 is ground off as zinc stearate fine particles having a diameter of about 1 $\mu$m by brush fibers of the cleaning brush 11 and is applied to the surface of the photoconductor 13 from the cleaning brush fibers. Thereafter, the fine particles of the solid lubricant 12 adhere to the photoconductor surface relatively strongly by an abutting pressure of the cleaning blade 14 onto the photoconductor 13. Considering developing efficiency, it is preferred that the amount of zinc stearate applied onto the photoconductor 13 be no larger than necessary. Thus, this image forming apparatus is configured so that the solid lubricant 12 is removable from the cleaning brush 11 by a removing mechanism (not shown) employing a solenoid. As the cleaning brush 11, a straight brush comprising 360 denier/24 filament carbon-containing acrylic fibers 124 and having a fiber density of 50000/in$^2$ and bristle length of about 5 mm is used. Use of a loop brush in which the brush fibers are loop-shaped as the cleaning brush 11 is not preferred because it grinds off the solid lubricant 12 excessively, so that too much zinc stearate is applied onto the photoconductor surface. The density and the thickness of the fibers of the cleaning brush 11 are determined according to the linear velocity, diameter, material of the photoconductor and the materials of the solid lubricant 12 so as to supply an optimum amount of zinc stearate to the photoconductor 13.

The area surrounded by dotted lines in FIG. 3 shows the process cartridge which integrally comprises the photoconductor, charging means, developing means, lubricant coating means, and cleaning means. Thus, the image forming means can be easily maintained and replaced.

In order to form an image with high fidelity and high quality, the toner for use in the image forming apparatus of the present invention has an average particle diameter of preferably 8 $\mu$m or less, more preferably 7 $\mu$m or less, and further preferably 1 to 6.5 $\mu$m. When the average particle diameter of the toner is 8 $\mu$m or less, an image of excellent quality can be produced but the characteristics of the photoconductor are likely to be reflected in a printed image. Thus, an image produced with an image forming apparatus employing a conventional photoconductor often has interference fringes. However, an image produced with the image forming apparatus employing the photoconductor according to the present invention is substantially free from interference fringes.

The image forming apparatus of the present invention can produce a high-quality image free from interference fringes in single-color image formation, multi-color image formation and full-color image formation. In color image formation, it is required to reproduce an image with higher fidelity as compared with monochromatic image formation. In color image formation, an image is formed by superimposing color component images. Thus, when interference fringes occur, the characteristics of the photoconductor are superimposed on a printed image, causing problems. However, the image forming apparatus according to the present invention can produce an image free from interference fringes also in color image formation.

A color image can be formed using the image forming apparatus of the present invention either by a method comprising the steps of forming a plurality of images of different colors on photoconductors and sequentially transferring the toner images onto an output medium (a paper, in most cases), or by a method comprising the steps of forming a plurality of images of different colors on photoconductors, laminating the toner images on an intermediate transfer member, and transferring the laminated toner image onto an output medium. However the image forming method using an intermediate transfer member, especially a method using an intermediate transfer belt as the intermediate transfer member, is preferred because it can improve image quality, prevent color misalignment, enhance transfer efficiency and flexibility to output media when image density is high.

As the intermediate transfer belt, a belt made of a fluororesin, a polycarbonate resin or a polyimide resin has been conventionally used but, in recent years, an elastic belt entirely of partially comprising an elastic material is spreading.

Transferring of a color image using a resin belt has a following problem.

A color image is generally formed of four color toners. In one color image, first to fourth toner layers are formed.

Since the toner layers receive pressure through a primary transfer (transfer from a photoconductor to the intermediate transfer belt) and a secondary transfer (transfer from the intermediate transfer belt to a sheet), the aggregation force among toner particles increases. When the aggregation force among toner particles is high, voids in letters and an edge void in a solid image are likely to occur.

A resin belt has high hardness, is not deformed according to toner layers, tends to compress toner layers and thus is likely to cause voids in letters.

In recent years, a demand for printing on various types of paper such as a Japanese paper and a paper embossed on purpose is increasing. However, a paper of low smoothness is apt to have a gap between itself and the toner layers, so that an image printed thereon is likely to have a transfer void. When a transfer pressure in the secondary transfer process is increased to enhance the adhesion of toner to the paper, the aggregation force among toner particles increases, thus causing voids in letters as above.

Thus, an elastic belt is suitable for the intermediate transfer belt. An elastic belt has lower hardness than a resin belt and thus is deformed according to toner layers and a paper of low smoothness in a transfer unit. Namely, the elastic belt is deformed following regional irregularity and enhances the adhesion of toners without unnecessarily increasing the transfer pressure onto the toner layers, so that an image with high uniformity and free from voids in letters can be produced even on a paper of low smoothness.

When a toner image formed on the intermediate transfer belt has a thickness exceeding 30 $\mu$m, a printed image formed using an inelastic intermediate belt is likely to have white voids. However, an elastic intermediate transfer belt can produce a high-quality image free from such problems.

Examples of resins for use in production of the elastic belt include, but are not limited to, polycarbonates; fluororesins such as ETFE (ethylene-tetrafluoroethylene copolymer), and PVDF (poly(vinylidene fluoride)); styrenic resins (homopolymers and copolymers containing styrene or a styrene derivative) such as polystyrenes, chloropolystyrenes, poly-α-methylstyrenes, styrene-butadiene copolymers, styrene-vinyl chloride copolymers, styrene-vinyl acetate copolymers, styrene-maleic acid copolymers, styrene-acrylic ester copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylic ester copolymers (e.g., styrene-methyl methacrylate copolymers, styrene-ethyl methacrylate copolymers, and styrene-phenyl methacrylate copolymers), styrene-methyl α-chloroacrylate copolymers, and styrene-acrylonitrile-acrylic ester copolymers; methyl methacrylate resins; butyl methacrylate resins; ethyl acrylate resins; butyl acrylate resins; modified acrylic resins (e.g., silicone-modified acrylic resins, vinyl chloride resin-modified acrylic resins, acrylic-urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylenes, polypropylenes, polybutadienes, poly(vinylidene chloride)s, ionomer resins, polyurethane resins, silicone resins, ketone resins, ethylene-ethyl acrylate copolymers, xylene resins, poly(vinyl butyral) resins, polyamide resins, and modified poly (phenylene oxide) resins. Each of these resins can be used alone or in combination.

Examples of rubbers and elastomers for use in the elastic belt include, but are not limited to, but are not limited to, butyl rubber, fluorocarbon rubber, acrylic rubber, ethylene-propylene rubber (EPDM), acrylonitrile-butadiene rubber (NBR), acrylonitrile-butadiene-styrene rubber, naturally-occurring rubber, isoprene rubber, styrene-butadiene rubber, butadiene rubber, ethylene-propylene rubber, ethylene-propylene terpolymers, chloroprene rubber, chlorosulfonated polyethylenes, chlorinated polyethylenes, urethane rubber, syndiotactic 1,2-polybutadiene, epichlorohydrin rubber, silicone rubber, fluorocarbon rubber, polysulfide rubber, polynorbornene rubber, hydrogenated nitrile rubber, thermoplastic elastomers such as polystyrene elastomers, polyolefin elastomers, poly(vinyl chloride) elastomers, polyurethane elastomers, polyamide elastomers, polyurea elastomers, polyester elastomers, and fluororesin elastomers. Each of these substances can be used alone or in combination.

The intermediate transfer member may further comprise a conducting agent for controlling the resistivity. Such conducting agents are not specifically limited and include, for example, carbon black, graphite, powders of aluminum, nickel, and other metals, tin oxide, titanium oxide, antimony oxide, indium oxide, potassium titanate, antimony-tin complex oxide (ATO), indium-tin complex oxide (ITO), and other conductive metal oxides. These conductive metal oxides may be covered with insulative fine particles such as barium sulfate, magnesium silicate, and calcium carbonate fine particles.

The material for forming a surface layer of the intermediate transfer member is not specifically limited as long as it reduces adhesion of the toner to the surface of the intermediate transfer member to enhance secondary transfer ability thereof. For example, the surface layer may comprise a resin such as polyurethane resins, polyester resins, and epoxy resins or a mixture thereof in which a powder or particles, or a mixture of powders or particles with different diameter, of a material which reduces surface energy and enhances lubricity such as fluororesins, fluorine compounds, carbon fluoride, titanium dioxide and silicon carbide or a mixture thereof are dispersed.

A fluoro rubber on which a fluorine-rich layer is formed by heat treatment to reduce surface energy may be also used.

The method for producing the belt is not specifically limited. Examples of the belt producing method include, but are not limited to, a centrifugal molding method in which the material is poured into a rotating cylindrical mold, a spray coating method in which a thin film is formed on a surface of a mold, a dipping method in which a cylindrical mold is immersed in a material solution and is drawn up, an injection molding method in which the material is poured between inner and outer molds, and a method in which a surface of a compound wound on a cylindrical mold is vulcanized and polished. These methods may be employed in combination.

Examples of methods for preventing elongation of the elastic belt include, but are not limited to, a method in which a rubber layer is formed on a core resin layer, a method in which a material which can prevent the elongation is added in a core layer.

Examples of materials for use in forming the core layer for preventing elongation of the elastic belt include, but are not limited to, natural fibers such as cotton, and silk; synthetic fibers such as polyester fibers, nylon fibers, acrylic fibers, polyolefin fibers, poly(vinyl alcohol) fibers, poly (vinyl chloride) fibers, poly(vinylidene chloride) fibers, polyurethane fibers, polyacetal fibers, polyfluoroethylene fibers, and phenol fibers; inorganic fibers such as carbon fibers, glass fibers, and boron fibers; and metal fibers such as iron fibers and copper fibers. Each of these materials can be used alone or in combination in the form of a woven fabric or threads.

The thread may be of one filament or a strand of filaments, or may be a single twisted yarn, plied yarn or two-ply yarn. A plurality of types of fibers selected from the above group may be mixed. The strand threads may be subjected to suitable conductive treatment.

The woven fabric may be woven in any method, for example, by knitting, and a union fabric can be also used. The woven fabric can be subjected to conductive treatment.

The method for preparing a core layer is not specifically limited. Examples of the core layer preparing method include a method in which a fabric is woven into a cylindrical shape and is laid on, for example, a mold and a cover layer is formed thereon, a method in which a woven fabric woven into a cylindrical shape is immersed in, for example, a liquid rubber to form a cover layer on one or both sides thereof, and a method in which a coating layer is formed on a thread helically wound on, for example, a mold at a given pitch.

When the thickness of the elastic layer is excessively large (about 1 mm or larger), the surface thereof expands and contracts so largely as to generate cracks therein or deformation of a printed image, although it depends on the hardness thereof.

The elastic layer preferably has a hardness in a range of 10 to 65 degrees (JIS-A), although the hardness must be adjusted according to the thickness of the belt. A belt having a hardness (JIS-A) of less than 10 degrees is very difficult to form with good dimensional accuracy. This is because the belt often undergoes contract or expansion during molding. In order to soften a belt, an oil component is frequently added in the support. However, when the belt is continuously used under a pressure (under a load), the oil component bleeds out and contaminates the photoconductor in contact with the surface of the intermediate transfer member, causing streaks in a lateral direction in a printed image.

In general, a surface layer is arranged on an intermediate transfer belt to avoid such a problem of the belt having an excessively low hardness. However, in order to prevent the oil component from bleeding out completely, the surface layer is required to be excellent in quality, in durability, for example, so that it is difficult to select the material therefor and to ensure properties required thereto. In contrast, an elastic layer having a hardness (JIS-A) exceeding 65 degrees has sufficient hardness and thus can be formed with accuracy. The elastic layer can be formed with a small amount of oil component or without oil component, so that the contamination of the photoconductor by the oil can be reduced. However, the elastic layer cannot provide an effect of improving toner transferability to prevent, for example, voids in letters and makes it difficult to span the intermediate transfer belt over rollers.

Image forming methods employable in the image forming apparatus of the present invention include a method in which toner images of different colors are formed on a single photoconductor and are sequentially transferred on an output medium or an intermediate transfer member, and a tandem method in which toner images of different colors are formed on a plurality of photoconductors, respectively, and are transferred onto an output medium or an intermediate transfer member. In order to respond to needs for high-speed image forming, it is preferable to use a plurality of photoconductors. Among them, in order to form a high-quality image, a tandem indirect transfer method is highly preferred in which toner images of different colors are formed on a plurality of photoconductors and are sequentially transferred onto an elastic intermediate transfer belt, and then the stacked toner image is secondarily transferred onto an output medium to form an image.

In such tandem image forming apparatus, toner images of different colors are formed on different photoconductors, respectively. Accordingly, I(S)s of the profile curves at the surfaces of the photoconductors used should fall within the range specified in the present invention to avoid interference fringes of a specific color and the resulting unnatural images.

Figure 5:
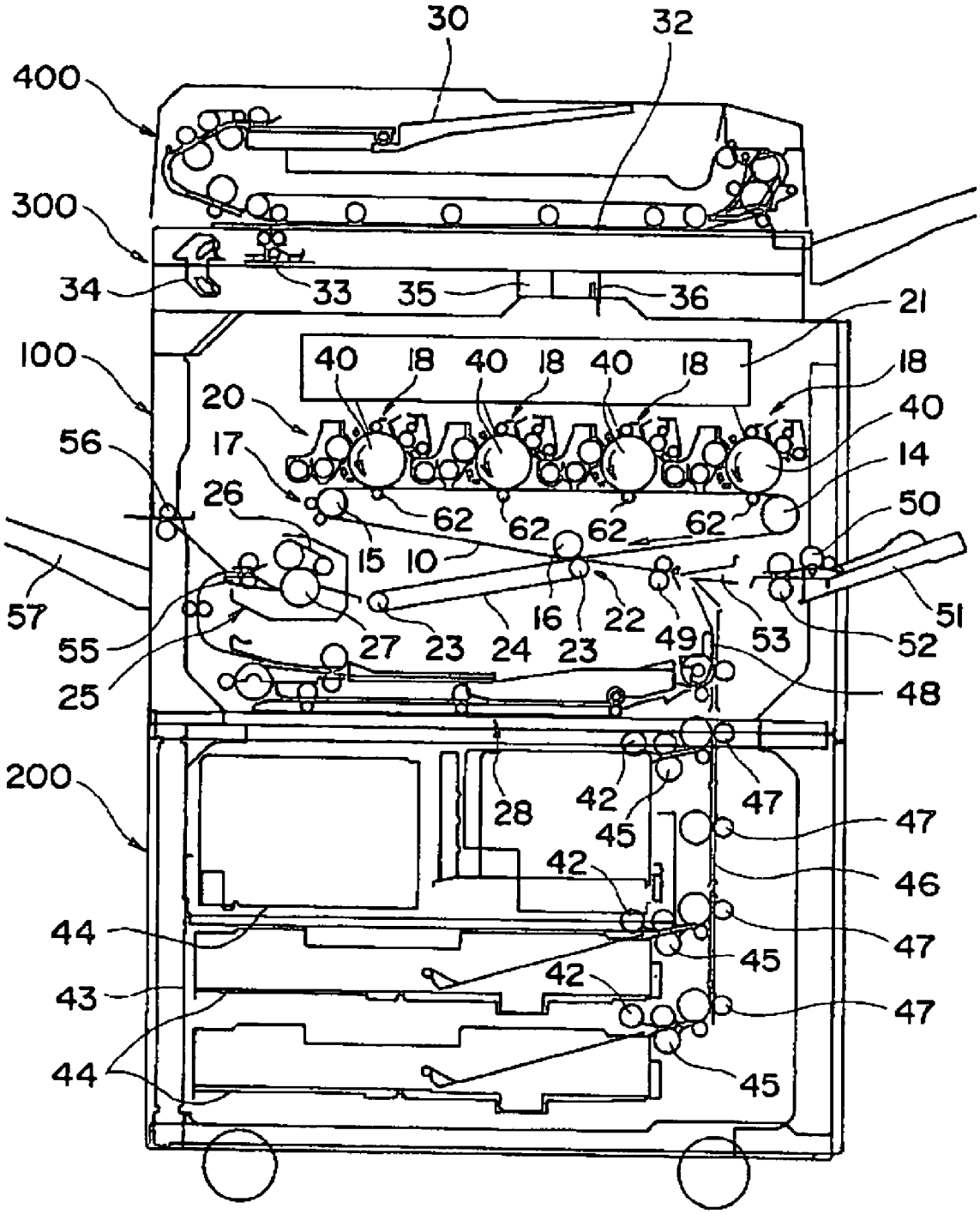
FIG. 5 is a schematic view of an example of a tandem indirect transfer color image forming apparatus.

FIG. 5 is a schematic diagram of an image forming apparatus of the tandem indirect transfer system. The apparatus includes a copying machine main body 100, a sheet feeder table 200 on which the copying machine main body 100 is placed, a scanner 300 arranged on the copying machine main body 100, and an automatic document (draft) feeder (ADF) 400 arranged on the scanner 300.

The copying machine main body 100 includes an endless-belt intermediate transfer member 10 at its center.

The intermediate transfer member 10 shown in FIG. 5 is spanned around three support rollers 14, 15 and 16 and is capable of rotating and moving in a clockwise direction in the figure.

This apparatus includes an intermediate transfer member cleaning device 17 on the left side of the second support roller 15. The intermediate transfer member cleaning device 17 is capable of removing a residual toner on the intermediate transfer member 10 after image transfer.

Above the intermediate transfer member 10 spanned between the first and second support rollers 14 and 15, black, yellow, magenta, and cyan image forming means 18 are arrayed in parallel in a moving direction of the intermediate transfer member 10 to thereby constitute a tandem image forming unit 20.

A light-exposing device 21 is arranged on the tandem image forming unit 20 as shown in FIG. 5.

A secondary transfer device 22 is arranged below the intermediate transfer member 10 on an opposite side to the tandem image forming unit 20. The secondary transfer device 22 in the example shown in FIG. 5 comprises an endless belt serving as a secondary transfer belt 24 spanned around two rollers 23. The secondary transfer belt 24 is pressed on the third support roller 16 with the interposition of the intermediate transfer member 10 and is capable of transferring an image on the intermediate transfer member 10 to a sheet.

An image-fixing device 25 is arranged beside the secondary transfer device 22 and is capable of fixing a transferred image on the sheet. The image-fixing device 25 comprises an endless image-fixing belt 26 and a pressure roller 27 pressed on the image-fixing belt 26.

The secondary transfer device 22 is also capable of transporting a sheet after image transfer to the image-fixing device 25. Naturally, a transfer roller or a non-contact electrostatic charger can be used as the secondary transfer device 22. In this case, the secondary transfer device 22 may not have the capability of transporting the sheet.

The apparatus shown in FIG. 5 also includes a sheet reverser 28 below the secondary transfer device 22 and the image-fixing device 25 in parallel with the tandem image forming unit 20. The sheet reverser 28 is capable of reversing the sheet so as to form images on both sides of the sheet.

A copy is made using the color electrostatic development apparatus in the following manner. Initially, a document is placed on a document platen 30 of the automatic document feeder 400. Alternatively, the automatic document feeder 400 is opened, the document is placed on a contact glass 32 of the scanner 300, and the automatic document feeder 400 is closed to press the document.

At the push of a start switch (not shown), the document, if any, placed on the automatic document feeder 400 is transported onto the contact glass 32. When the document is initially placed on the contact glass 32, the scanner 300 is immediately driven to operate a first carriage 33 and a second carriage 34. Light is applied from a light source to the document, and reflected light from the document is further reflected toward the second carriage 34 at the first carriage 33. The reflected light is further reflected by a mirror of the second carriage 34 and passes through an image-forming lens 35 into a read sensor 36 to thereby read the document.

At the push of the start switch (not shown), a drive motor (not shown) rotates and drives one of the support rollers 14, 15 and 16 to allow the residual two support rollers to rotate following the rotation of the one support roller to thereby rotatively convey the intermediate transfer member 10. Simultaneously, the individual image forming means 18 rotate their photoconductors 40 to thereby form black, yellow, magenta, and cyan monochrome images on the photoconductors 40, respectively. With the conveying intermediate transfer member 10, the monochrome images are sequentially transferred to form a composite color image on the intermediate transfer member 10.

Separately at the push of the start switch (not shown), one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copying machine main body 100 and are bumped against a resist roller 49.

Alternatively, the push of the start switch rotates a feeder roller 50 to eject sheets on a manual bypass tray 51, the sheets are separated one by one on a separation roller 52 into a manual bypass feeder path 53 and are bumped against the resist roller 49.

The resist roller 49 is rotated synchronously with the movement of the composite color image on the intermediate transfer member 10 to transport the sheet into between the intermediate transfer member 10 and the secondary transfer device 22, and the composite color image is transferred onto the sheet by action of the secondary transfer device 22 to thereby record a color image on the sheet.

The sheet bearing the transferred image is transported by the secondary transfer device 22 into the image-fixing device 25, is applied with heat and pressure in the image-fixing device 25 to fix the transferred image, changes its direction by action of a switch blade 55, is ejected by an ejecting roller 56 and is stacked on an output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 onto the output tray 57.

Separately, the intermediate transfer member cleaning device 17 removes a residual toner on the intermediate transfer member 10 after image transfer for another image forming procedure by the tandem image forming unit 20.

The resist roller 49 is generally grounded, but it is also acceptable to apply a bias thereto for the removal of paper dust of the sheet.

In an intermediate transfer system, paper powder is not likely to be transported to photoconductors and thus does not have to be taken into consideration. Thus, the resist roller 49 may be grounded.

As the applied voltage, a DC bias is applied, but it may be an AC voltage having a DC offset component to electrify the sheet more uniformly.

The surfaces of the sheet passed through the resist roller 49 applied with bias is slightly negatively charged. Thus, the conditions in transferring of an image from the intermediate transfer member 10 to a sheet may be changed from those in the case where no voltage is applied to the resist roller 49.

Figure 6:
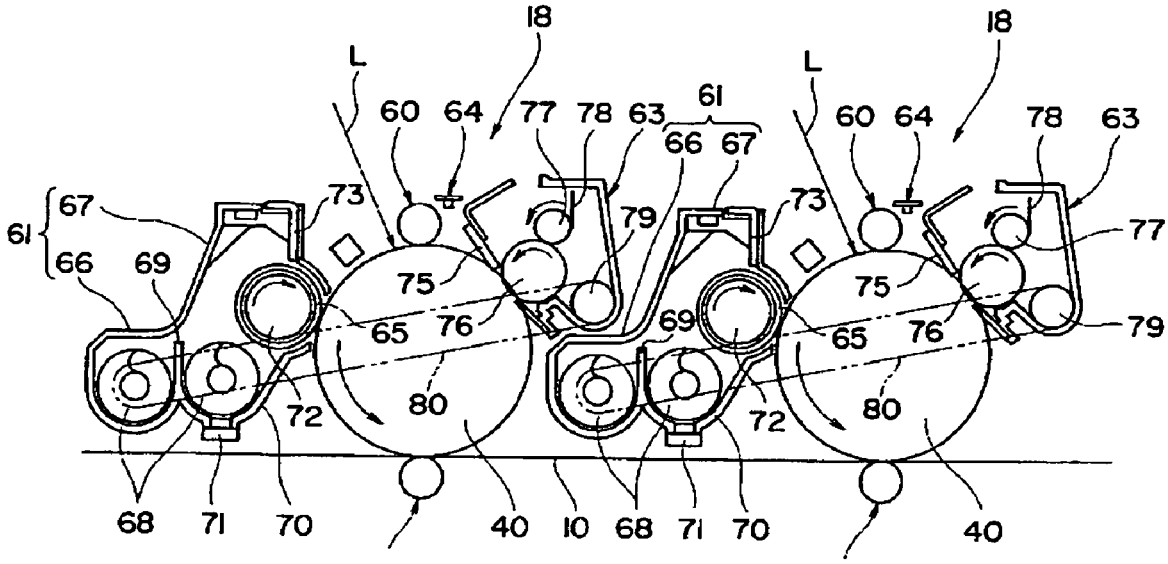
FIG. 6 is a view showing configurations of individual image forming devices in the tandem image forming apparatus of FIG. 5.

Each of the image forming means 18 in the tandem image forming unit 20 comprises the drum-like photoconductor 40, as well as an electrostatic charger 60, a development device 61, a primary transfer device 62, a photoconductor cleaning device 63, a charge eliminator 64, and other components arranged around the photoconductor 40 according to necessity, as shown in FIG. 6.

The resolution of an output image of the image forming apparatus of the present invention is not specifically limited. The image forming apparatus can produce a high-quality image when the resolution is 1000 dpi or higher, preferably 1200 dpi or higher. In such an output image with a high resolution, the characteristics of the photoconductor tend to be reflected. Thus, an image forming apparatus employing a conventional photoconductor is apt to generate image defects such as interference fringes. However, the image forming apparatus of the present invention is substantially free from such problems.

The wavelength of writing light for use in the image forming apparatus of the present invention is not specifically limited but is generally preferably 700 nm or less, more preferably 675 nm or less, and further preferably 370 to 600 nm. The image forming apparatus of the present invention can produce an excellent image with a high resolution and high definition without generating image defects such as interference fringes even with writing light with a short wavelength, which can produce an output image with high resolution.

The method for reproducing gradation for use in the image forming apparatus of the present invention is not specifically limited. In a multi-level gradation reproducing system, density of pixels is set in a stepwise. Thus, an image forming apparatus employing a conventional photoconductor tends to generate interference fringes in a printed image, and the tendency is strong in an image forming apparatus employing a pulse width modulation system, a power modulation system or a system in which width modulation and power modulation are combined. However, the image forming apparatus of the present invention does not generate interference fringes even with a multi-level gradation reproducing system.

The field intensity at the surface of the photoconductor of the image forming apparatus upon electrification is preferably $1.8\times10^5$ V/cm or more, more preferably $2.0\times10^5$ V/cm or more, and specifically preferably $2.2\times10^5$ V/cm to $4.0\times10^5$ V/cm. If the field intensity is excessively low, the apparatus may not form images with good quality. If it is excessively high, discharge breakdown may often occur.

EXAMPLES

The present invention will be illustrated in further detail with reference to several examples and comparative examples below, which are not intended to limit the scope of the present invention.

Examples 1 and 2, Comparative Example 1

Three aluminum drums were subjected to cutting with a flat cutting tool to thereby yielded machined aluminum drums having a diameter of 90 mm, a length of 352 mm and a thickness of 2.5 mm.

A total of 15 parts by weight of an acrylic resin (Acrydic A-460-60, available from Dainippon Ink & Chemicals, Inc., Japan) and 10 parts by weight of a melamine resin (Super Beckamine L-121-60, available from Dainippon Ink & Chemicals, Inc., Japan) were dissolved in 80 parts by weight of methyl ethyl ketone. To the solution was added 90 parts by weight of a titanium oxide powder (TM-1, available from Fuji Titanium Industry Co., Ltd., Japan). The mixture was dispersed in a ball mill for 12 hours to prepare a coating liquid for an undercoat layer. The aluminum drum was immersed in the undercoat layer coating liquid and was then vertically drawn up at a constant rate to coat the drum with the coating liquid. The aluminum drum was moved to a drying room with its attitude maintained and was dried therein at 140° C. for 20 minutes to form an undercoat layer having a thickness of 2.0 $\mu$m thereon.

The surface of the undercoat layer at a center part of the photoconductor was determined for a profile curve using a surface roughness meter (Surfcom 1400A, available from Tokyo Seimitsu Co., Ltd., Japan). From the profile curve, N=4096 points were sampled at an interval of $\Delta t=1250/4096$ $\mu$m in a reference line direction and were subjected to the discrete Fourier transform. Then, the power spectrum was calculated, and the I(S) obtained therefrom was found to be $1.3\times10^{-3}$.

In 150 parts by weight of cyclohexanone was dissolved 15 parts by weight of a butyral resin (S-LEC BLS, available from Sekisui Chemical Co., Ltd., Japan). To the solution was added 10 parts by weight of a trisazo pigment having a structure represented by the following structural formula (Formula 1), and the resulting mixture was dispersed in a ball mill for 60 hours.

Formula 1

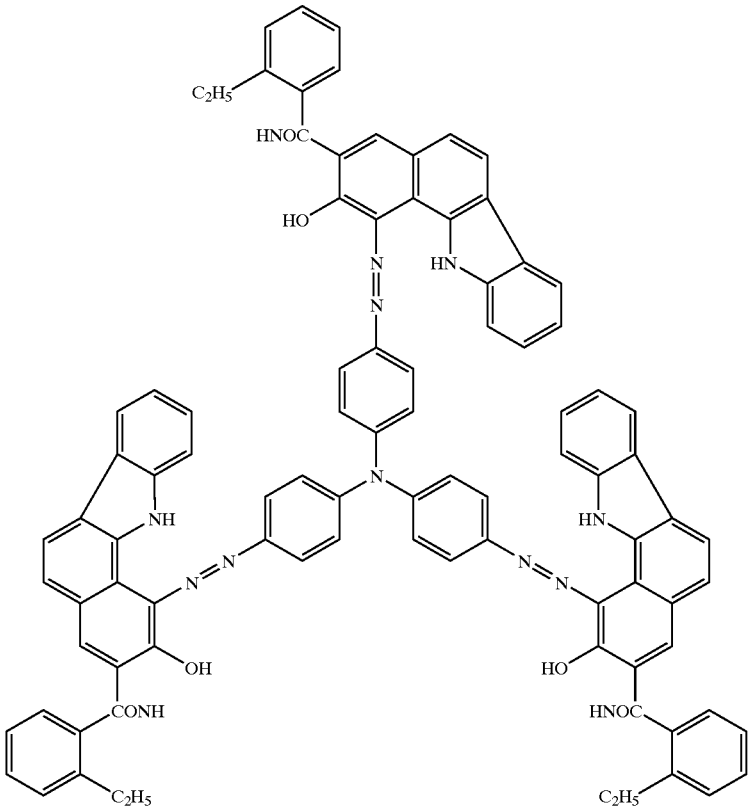

The mixture was diluted with 210 parts by weight of cyclohexanone and was further dispersed for 5 hours. The dispersion was diluted with cyclohexanone with stirring to a solid content of 1.5% by weight and thereby yielded a coating liquid for a charge generating layer. The aluminum drum bearing the undercoat layer was immersed in the charge generating layer coating liquid and was vertically drawn up at a constant rate to coat the drum with the coating liquid and then was dried in the same manner as in the undercoat layer at 120° C. for 20 minutes to form a charge generating layer having a thickness of about 0.2 μm.

The aluminum drum bearing the undercoat layer and the charge generating layer was then immersed in a coating liquid for a charge transporting layer. This coating liquid had been obtained by dissolving 6 parts by weight of a charge transporting material having a structure represented by the following structural formula (Formula2), 10 parts by weight of a polycarbonate resin (Panlite K-1300, available from Teijin Chemicals, Ltd., Japan), 0.002 parts by weight of a silicone oil (KF-50, available from Shin-Etsu Chemical Co., Ltd., Japan) in 90 parts by weight of methylene chloride.

Formula 2

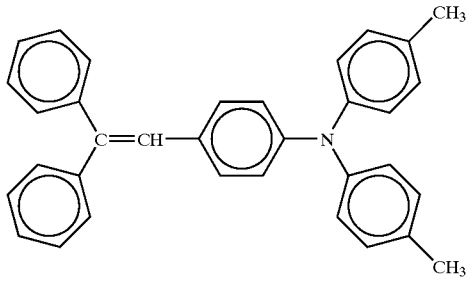

The aluminum drum was immersed in the coating liquid for a charge transporting layer and was drawn up vertically at a constant rate, was dried in the same manner as in the undercoat layer at 120° C. for 20 minutes to form a charge transporting layer having a thickness of about 23 μm on the charge generating layer.

The surfaces of two of the three photoconductors thus obtained were wrapped with a wrapping tape (C-2000, available from Fuji Photo Film Co., Ltd., Japan) for 15 seconds and 30 seconds, respectively, and thereby yielded photoconductors of Examples 1 and 2. The one whose surface was not wrapped was designated as Comparative Example 1.

The surface of each of the thus obtained photoconductors at a center part thereof was measured for a profile curve using a surface roughness meter (Surfcom 1400A, available from Tokyo Seimitsu Co., Ltd., Japan). From the profile curve, N=4096 points were sampled at an interval of $\Delta t=1250/4096$ $\mu$m in a reference line direction and were subjected to the discrete Fourier transform. Then, the power spectrum was calculated and the I(S) was obtained therefrom. The results are shown in Table 1.

Each of the photoconductors was incorporated in a tuned copying machine (Imagio Color 2800, available from Ricoh Company, Ltd., Japan; wavelength of writing light: 780 nm, resolution of output image: 400 dpi) employing a 12-level halftone reproduction system by combination of pulse width modulation and power modulation. This copying machine was tuned to use a conductive rubber roller having a diameter of 12 mm as an electrostatic charger. A uniform black-and-white halftone image was then printed out. The results are shown in Table 1.

TABLE 1

| | I(S) at interface of photoconductive layer on the support side | I(S) at photoconductor surface | Black-and-white halftone image |
|---|---|---|---|
| Example 1 | $1.3 \times 10^{-3}$ | $2.8 \times 10^{-3}$ | uniform, no image defects |
| Example 2 | $1.3 \times 10^{-3}$ | $3.1 \times 10^{-3}$ | uniform, no image defects |
| Com. Ex. 1 | $1.3 \times 10^{-3}$ | $1.5 \times 10^{-3}$ | moire interference fringes observed at a center part of the image |

Example 3, Comparative Example 2

A halftone image was printed out in the same manner as in Example 2 and Comparative Example 1, respectively, except that the copying machine (Imagio Color 2800) was modified such that the image writing resolution was 600 dpi. The results are shown in Table 2.

TABLE 2

| | Photoconductor used | Black-and-white halftone image |
|---|---|---|
| Example 3 | Example 2 | uniform, no image defects |
| Com. Ex. 2 | Com. Ex. 1 | significant moire-like interference fringes observed at a center part of the image, and streaks observed at the edge of the image |

Example 4

In 100 parts by weight of methyl ethyl ketone were dissolved 3 parts by weight of an alkyd resin (Beckosol 1307-60-EL, available from Dainippon Ink & Chemicals, Inc., Japan), and 2 parts by weight of a melamine resin (Super Beckamine G 821-60, available from Dainippon Ink & Chemicals, Inc., Japan). To the solution was added 20 parts by weight of a titanium oxide powder (CR-EL available from Ishihara Sangyo Kaisha, Ltd., Japan). The mixture was dispersed in a ball mill for 200 hours and thereby yielded a coating liquid for an undercoat layer.

An unmachined aluminum drum having a diameter of 30 mm, a length of 340 mm and a thickness of about 0.75 mm was immersed in the undercoat layer coating liquid and was then vertically drawn up at a constant rate to coat the drum with the coating liquid. The aluminum drum was moved to a drying room with its attitude maintained and was dried therein at 140° C. for 20 minutes to form an undercoat layer having a thickness of 5.5 $\mu$m thereon.

The surface of the undercoat layer at a center part of the photoconductor was determined for a profile curve using a surface roughness meter (Surfcom 1400A, available from Tokyo Seimitsu Co., Ltd., Japan). From the profile curve, N=4096 points were sampled at an interval of $\Delta t=1250/4096$ $\mu$m in a reference line direction and were subjected to the discrete Fourier transform. Then, the power spectrum was calculated, and the I(S) obtained therefrom was found to be $1.1\times10^{-3}$.

In 200 parts by weight of methyl ethyl ketone was dissolved 2 parts by weight of a poly(vinyl butyral) resin (Vinylite XYHL, available from The Dow Chemical Company, MI, USA). To the solution was added 10 parts by weight of a bis azo pigment having a structure represented by the following structural formula (Formula 3). The mixture was then dispersed in a ball mill for 340 hours.

Formula 3

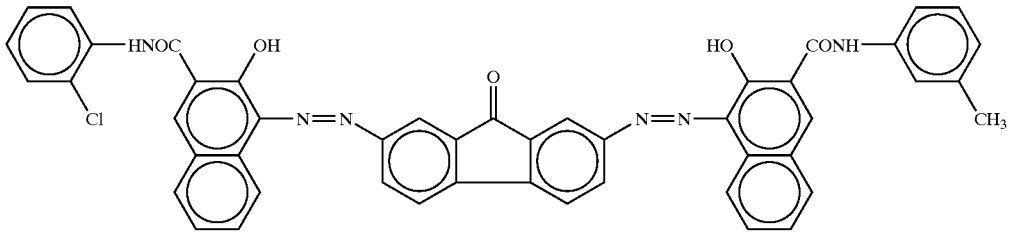

The mixture was diluted with 200 parts by weight of cyclohexanone and was further dispersed for 1 hour. The dispersion was diluted with cyclohexanone to a solid content of 1.5% by weight with stirring and thereby yielded a coating liquid for a charge generating layer. The aluminum drum bearing the undercoat layer was immersed in the charge generating layer coating liquid and was vertically drawn up at a constant rate to coat the drum with the coating liquid and was then dried in the same manner as in the undercoat layer at 120° C. for 20 minutes to thereby form a charge generating layer having a thickness of about 0.2 μm.

In 8 parts by weight of tetrahydrofuran were dissolved 1 part by weight of a charge transporting material having a structure represented by the following structural formula (Formula4), 1 part by weight of a bisphenol Z type polycarbonate and 0.04 part by weight of a silicone oil (KF-50, available from Shin-Etsu Chemical Co., Ltd., Japan), and thereby yielded a coating liquid for a charge transporting layer. The aluminum drum bearing the undercoat layer and the charge generating layer was immersed in the charge transporting layer coating liquid to coat the drum with the coating liquid and was dried in the same manner as in the undercoat layer at 120° C. for 20 minutes to thereby form a charge transporting layer having a thickness of about 23 μm on the charge generating layer.

Formula 4

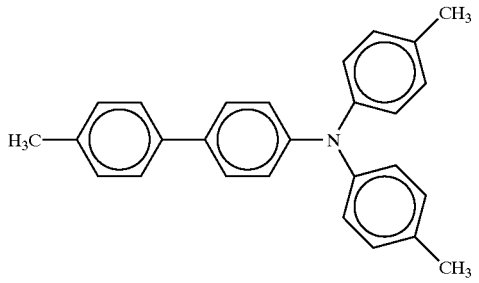

A total of 3 parts by weight of the above charge transporting material, 3 parts by weight of a 1:1 mixture of an aluminum oxide powder having a purity of 4N and an average particle diameter of 0.3 μm and one having a purity of 4N and an average particle diameter of 0.1 μm, and 4 parts by weight of a bisphenol Z type polycarbonate were added to 55 parts by weight of cyclohexanone. The mixture was dispersed for 50 hours, was diluted with tetrahydrofuran to a solid content of 5% by weight and was further dispersed. The dispersion was applied onto the charge transporting layer by spray coating, was dried at 145° C. for 20 minutes and thereby yielded an outermost layer having a thickness of about 3.3 μm.

The surface of the photoconductor at a center part thereof was determined for a profile curve using a surface roughness meter (Surfcom 1400A, available from Tokyo Seimitsu Co., Ltd., Japan). From the profile curve, N=4096 points were sampled at an interval of $\Delta t=1250/4096$ μm in a reference line direction and were subjected to the discrete Fourier transform. Then, the power spectrum was calculated, and the I(S) obtained therefrom was found to be $2.9\times10^{-3}$.

The photoconductor was incorporated in a copying machine (Imagio MF2200 available from Ricoh Company, Ltd., Japan) to fabricate an image forming apparatus. The copying machine had been modified such that the wavelength of the writing light was 655 nm, the image writing resolution was 600 dpi, the spot diameter of the writing light was 60 μm and the photoconductor was arranged in contact with the electrostatic charger roller. When a uniform black-and-white halftone image was printed out using the image forming apparatus, a uniform black-and-white halftone image free from image defects such as interference fringes was obtained. A white image was then printed out, and a white image without image defects was obtained.

Comparative Example 3

An image forming apparatus was prepared by the procedure of Example 4, except that an aluminum drum having a diameter of 30 mm, a length of 340 mm, and a thickness of about 0.75 mm obtained by machining an aluminum drum with a cutting tool of 1.5 R was used as the photoconductor drum.

The surface of the undercoat layer at a center part of the photoconductor was determined for a profile curve using a surface roughness meter (Surfcom 1400A, available from Tokyo Seimitsu Co., Ltd., Japan) in the same manner as in Example 4. From the profile curve, N=4096 points were sampled at an interval of $\Delta t=1250/4096$ μm in a reference line direction and were subjected to the discrete Fourier transform. Then, the power spectrum was calculated, and the I(S) obtained therefrom was found to be $8.9\times10^{-3}$.

The surface of the photoconductor at a center part thereof was determined for a profile curve at a measuring length of 5 mm using a surface roughness meter (Surfcom 1400A, available from Tokyo Seimitsu Co., Ltd., Japan). From the profile curve, N=4096 points were sampled at an interval of $\Delta t=1250/4096$ μm in a reference line direction and were subjected to the discrete Fourier transform. Then, the power spectrum was calculated, and the I(S) obtained therefrom was found to be $3.6\times10^{-3}$.

When a uniform black-and-white halftone image was printed out using the image forming apparatus in the same manner as in Example 4, a uniform black-and-white halftone image free from image defects such as interference fringes was obtained. A white image was then printed out, and the resulting image carried black spots (black voids) about 0.1 μm in diameter overall thereon.

Comparative Examples 4 and 5

A photoconductor was prepared by the procedure of Example 4, except that an aluminum oxide having an average particle diameter of 1.1 μm was used instead of the aluminum oxide having an average particle diameter of 0.3 μm in the coating solution for an outermost layer (Comparative Example 4).

Another photoconductor was prepared by the procedure of Example 4, except that no aluminum oxide was added to the coating solution for an outermost layer (Comparative Example 5).

The surfaces of the undercoat layers and of the photoconductors were determined for a profile curve using a surface roughness meter (Surfcom 1400A, available from Tokyo Seimitsu Co., Ltd., Japan) by the procedure of Example 4. From the profile curve, N=4096 points were sampled at an interval of Δt=1250/4096 μm in a reference line direction and were subjected to the discrete Fourier transform. Then, the power spectrum was calculated, and the I(S) was obtained therefrom.

Image forming apparatus were prepared using the above-prepared photoconductors by the procedure of Example 4, and a uniform black-and-white halftone image and a white image were printed out using these image forming apparatus. The results are shown in Table 3.

TABLE 3

| | I(S) at interface of photoconductive layer on the support side | I(S) at photoconductor surface | Image |
|---|---|---|---|
| Com. Ex. 4 | $1.0 \times 10^{-3}$ | $10.7 \times 10^{-3}$ | black spots 0.05 to 0.1 μm in diameter observed in a part of the white image |
| Com. Ex. 5 | $1.0 \times 10^{-3}$ | $1.4 \times 10^{-3}$ | interference fringes 3 to 15 mm in diameter observed overall in the black-and-white halftone image |

Example 5

After printing out 600000 copies of an image using the image forming apparatus according to Example 4, a uniform black-and-white halftone image was printed out. As a result, a uniform black-and-white halftone image free from image defects such as interference fringes was obtained.

The surface of the photoconductor at a center part thereof was determined for a profile curve using a surface roughness meter (Surfcom 1400A, available from Tokyo Seimitsu Co., Ltd., Japan) by the procedure of Example 4. From the profile curve, N=8192 points were sampled at an interval of Δt=2500/8192 μm in a reference line direction and were subjected to the discrete Fourier transform. Then, the power spectrum was calculated, and the I(S) obtained therefrom was found to be $4.6\times10^{-3}$.

Example 6

The following composition was placed in a ball mill pot together with alumina balls with a diameter of 10 mm and was milled for 20 hours.

| | |
|---|---|
| Titanium dioxide (CR-60; Ishihara Sangyo Kaisha, Ltd., Japan) | 50.0 parts by weight |
| Alkyd resin (Beckolite M6401-50, Dainippon Ink & Chemicals, Inc., Japan) | 15.0 parts by weight |
| Melamine resin (Super Beckamine L-121-60, Dainippon Ink & Chemicals, Inc., Japan) | 10.0 parts by weight |
| Methyl ethyl ketone (Kanto Kagaku Co., Ltd., Japan) | 33.7 parts by weight |

The milled mixture was further mixed with 105.0 parts by weight of cyclohexanone (available from Kanto Kagaku Co., Ltd.) in a ball mill for 12 hours and thereby yielded a coating liquid for an undercoat layer. The coating liquid was applied by spray coating to a surface of a seamless, endless nickel belt (Vickers hardness: 480 to 510, purity: 99.2% or more) having a peripheral length of 290.3 mm and a thickness of 30 μm, and the coating was dried at 135° C. for 25 minutes and thereby yielded an undercoat layer having a thickness of 4.0 μm.

The surface of the undercoat layer at a center part of the photoconductor was determined for a profile curve using a surface roughness meter (Surfcom 1400A, available from Tokyo Seimitsu Co., Ltd., Japan). From the profile curve, N=8192 points were sampled at an interval of Δt=5000/8192 μm in a reference line direction and were subjected to the discrete Fourier transform. Then, the power spectrum was calculated, and the I(S) obtained therefrom was found to be $3.8\times10^{-3}$.

A mixture of 1.5 parts by weight of a charge generating material represented by following Chemical Formula 1 (available from Ricoh Company, Ltd., Japan), 1.5 parts by weight of a charge generating material represented by following Chemical Formula 2 (available from Ricoh Company, Ltd., Japan), 1.0 part by weight of a poly(vinyl butyral) resin (S-LEC BLS, available from Sekisui Chemical Co., Ltd., Japan), and 80.0 parts by weight of cyclohexanone (available from Kanto Kagaku Co., Ltd., Japan) was placed in a ball mill pot together with agate balls with a diameter of 10 mm and was milled for 200 hours. The mixture was further mixed with 78.4 parts by weight of cyclohexanone and 237.6 parts by weight of methyl ethyl ketone and thereby yielded a coating liquid for a charge generating layer. The coating liquid was applied onto the undercoat layer on the belt by spray coating, was dried at 130° C. for 20 minutes and thereby yielded a charge generating layer having a thickness of 0.12 μm.

Next, a coating liquid having the following composition for a charge transporting layer was prepared, was applied onto the charge generating layer by spray coating, was dried at 140° C. for 30 minutes and thereby yielded a charge transporting layer having a thickness of 25 μm.

| | |
|---|---|
| Charge transporting material of Chemical Formula III (Ricoh Company, Ltd., Japan) | 7 parts by weight |
| Polycarbonate resin (C-1400, Teijin Chemicals, Ltd., Japan) | 10 parts by weight |
| Silicone oil (KF-50, Shin-Etsu Chemical Co., Ltd., Japan) | 0.002 part by weight |
| Tetrahydrofuran (Kanto Kagaku Co., Ltd., Japan) | 841.5 parts by weight |
| Cyclohexanone (Kanto Kagaku Co., Ltd., Japan) | 841.5 parts by weight |
| 3-t-Butyl-4-hydroxyanisole (Tokyo Chemical Industry Co., Ltd., Japan) | 0.04 part by weight |

The resulting photoconductor belt was cut into a width of 367 mm.

Cemical Formula I

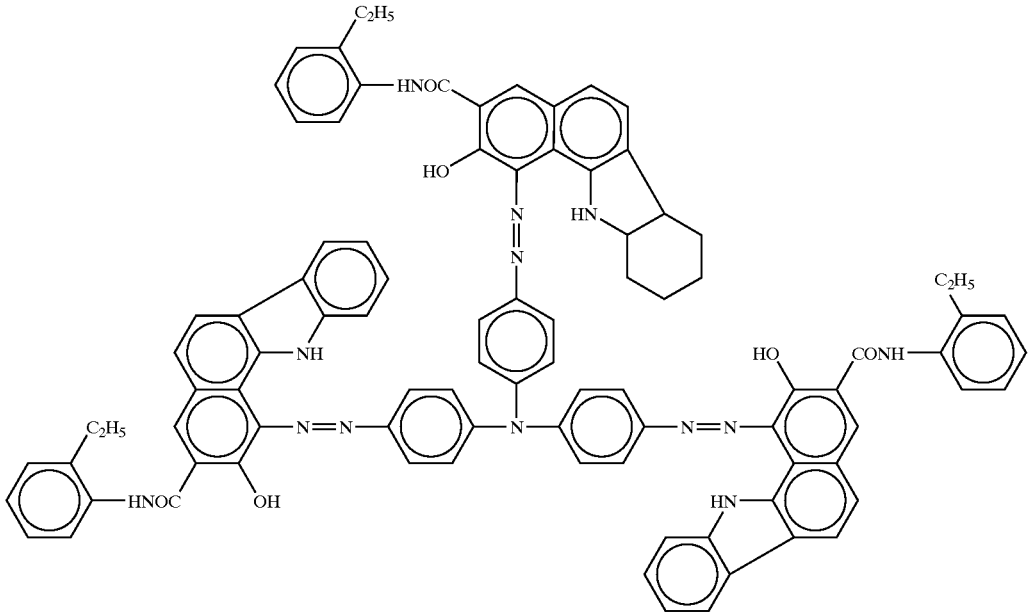

Chemical Formula II

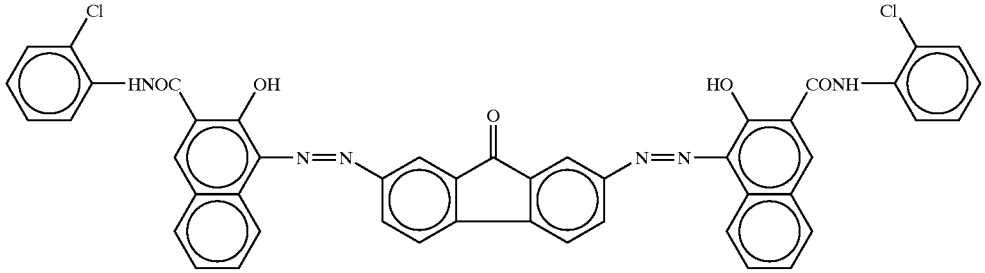

Chemical Formula III

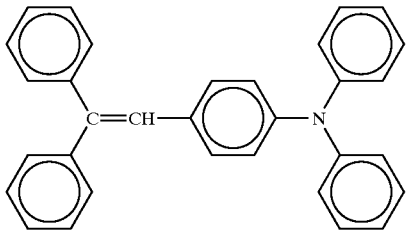

A coating liquid for an outermost layer was prepared in the following manner. A total of 2 parts by weight of the charge transporting material of Chemical Formula III, 3 parts by weight of aluminum oxide (purity: 4N, average particle diameter: 0.3 $\mu$m), 4 parts by weight of a bisphenol Z type polycarbonate, and 1 part by weight of a polymer donor (the aforementioned Compound A) were added to 50 parts by weight of cyclohexanone. After 35-hour dispersing operation, the dispersion was diluted with tetrahydrofuran to a solid content of 5% by weight and was further dispersed. The coating liquid was then applied onto the charge transporting layer by spray coating, was dried at 145° C. for 20 minutes and thereby yielded an outermost layer having a thickness of about 3.5 $\mu$m.

Two strips of an urethane rubber (DUS 216 70A, available from Sheedom Co., Ltd., Japan) having a thickness of 0.8 mm and a rubber hardness of 70 A were bonded with an acrylate adhesive to both side end regions of the inside surface of the photoconductor belt to form guides for preventing lateral movement of the belt and thereby yielded a photoconductor.

The surface of the photoconductor at a center part thereof was determined for a profile curve using a surface roughness meter (Surfcom 1400A, available from Tokyo Seimitsu Co., Ltd., Japan). From the profile curve, N=8192 points were sampled at an interval of $\Delta t=5000/8192$ $\mu$m in a reference line direction and were subjected to the discrete Fourier transform. Then, the power spectrum was calculated, and the I(S) obtained therefrom was found to be $2.9\times10^{-3}$.

The photoconductor belt was then incorporated into a tuned image forming apparatus (IPSiO Color 5000, available from Ricoh Company, Ltd., Japan) to thereby constitute an image forming apparatus. This apparatus had been tuned such that the wavelength of writing light was 655 nm, the image writing resolution was 600 dpi, and the distance between the photoconductor and the electrostatic charger roller was 20 μm. A black-and-white halftone image was outputted, and a high grade halftone image free of image defects such as interference fringes was obtained.

In addition, a color scenic shot was taken using a scanner, and a color image thereof was outputted. A high-quality image was obtained.

Example 7

An image forming apparatus was prepared by the procedure of Example 6, except that the image writing resolution was changed to 1200 dpi. A uniform black-and-white halftone image was then outputted, and a uniform high-quality halftone image was obtained.

After printing out 150000 copies of an image, a uniform black-and-white halftone image was outputted. As a result, a uniform and high-quality image was obtained. The surface of the photoconductor at a center part thereof after this procedure was determined for a profile curve using a surface roughness meter (Surfcom 1400A, available from Tokyo Seimitsu Co., Ltd., Japan). From the profile curve, N=4096 points were sampled at an interval of Δt=1250/4096 μm in a reference line direction and were subjected to the discrete Fourier transform. Then, the power spectrum was calculated, and the I(S) obtained therefrom was found to be $3.5\times10^{-3}$.

Example 8

Aluminum drums were machined on their surfaces with a flat cutting tool and an R cutting tool with 2.5 R and thereby yielded four aluminum drums having a diameter of 60 mm, a length of 352 mm, and a thickness of 2.0 mm.

In 100 parts by weight of methyl ethyl ketone were dissolved 3 parts by weight of an alkyd resin (Beckosol 1307-60-EL, available from Dainippon Ink & Chemicals, Inc., Japan) and 2 parts by weight of a melamine resin (Super Beckamine G-821-60, available from Dainippon Ink & Chemicals, Inc., Japan). To the solution was added 20 parts by weight of a titanium oxide powder (CR-EL, available from Ishihara Sangyo Kaisha, Ltd., Japan). The mixture was then dispersed in a ball mill for 200 hours and thereby yielded a coating liquid for an undercoat layer.

The above aluminum drum was immersed in the undercoat layer coating liquid and was then vertically drawn up at a constant rate to coat the drum with the coating liquid. The aluminum drum was moved to a drying room with its attitude maintained and was dried therein at 140° C. for 20 minutes to form an undercoat layer having a thickness of 3.5 μm thereon.

The surface of the undercoat layer at a center part of the photoconductor was determined for a profile curve using a surface roughness meter (Surfcom 1400A, available from Tokyo Seimitsu Co., Ltd., Japan). From the profile curve, N=4096 points were sampled at an interval of Δt=1250/4096 μm in a reference line direction and were subjected to the discrete Fourier transform. Then, the power spectrum was calculated, and the I(S) obtained therefrom was found to be $2.8\times10^{-3}$.

In 200 parts by weight of methyl ethyl ketone was dissolved 2 parts by weight of a poly(vinyl butyral) resin (Vinylite XYHL, available from The Dow Chemical Company, MI, USA). To the solution was added 10 parts by weight of a bisazo pigment having a structure represented by the following formula (Formula5), and the mixture was dispersed in a ball mill for 340 hours.

Formula 5

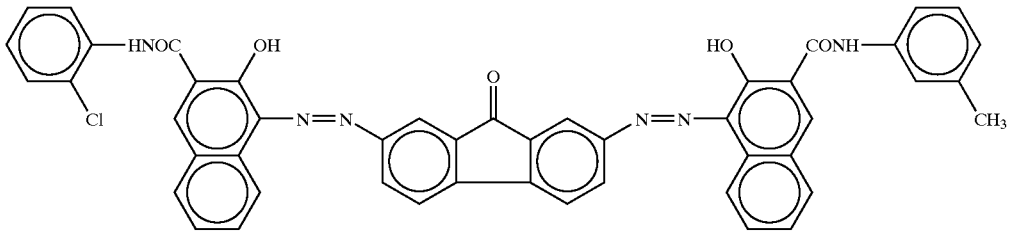

The dispersion was diluted with 200 parts by weight of cyclohexanone, was dispersed for 1 hour, was then diluted with cyclohexanone with stirring to a solid content of 1.5% by weight and thereby yielded a coating liquid for a charge generating layer. The aluminum drum bearing the undercoat layer was immersed in the charge generating layer coating liquid to coat the drum with the coating liquid and was then dried in the same manner as in the undercoat layer at 120° C. for 20 minutes to form a charge generating layer having a thickness of about 0.2 μm.

In 8 parts by weight of tetrahydrofuran were dissolved 1 part by weight of a charge transporting material having a structure represented by the following structural formula (Formula6), 1 part by weight of a bisphenol Z type polycarbonate, and 0.04 part by weight of a silicone oil (KF-50, available from Shin-Etsu Chemical Co., Ltd., Japan) and thereby yielded a coating liquid for a charge transporting layer. The aluminum drum bearing the undercoat layer and the charge generating layer was immersed in the charge transporting layer coating liquid to coat the drum with the coating liquid and was dried in the same manner as in the undercoat layer at 120° C. for 20 minutes to form a charge transporting layer having a thickness of about 10.5 μm on the charge generating layer.

Formula 6

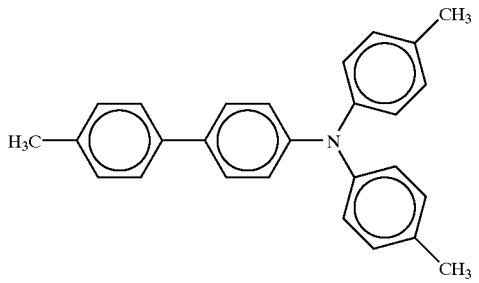

To 50 parts by weight of cyclohexanone were added 3 parts by weight of the above charge transporting material, 3 parts by weight of an aluminum oxide powder having a purity of 4N and an average particle diameter of 0.3 μm, and 4 parts by weight of a bisphenol Z type polycarbonate. The mixture was dispersed for 24 hours, was then diluted with tetrahydrofuran to a solid content of 5% by weight and was further dispersed. The dispersion was applied onto the charge transporting layer by spray coating, was dried at 145° C. for 20 minutes and thereby yielded an outermost layer having a thickness of about 3.2 μm. A total of four photoconductors was prepared by the above procedure.

The surfaces of the above-prepared photoconductors at a center part thereof were determined for a profile curve using a surface roughness meter (Surfcom 1400A, available from Tokyo Seimitsu Co., Ltd., Japan). From the profile curve, N=4096 points were sampled at an interval of $\Delta t=2500/4096$ μm in a reference line direction and were subjected to the discrete Fourier transform. Then, the power spectrum was calculated, and the I(S) obtained therefrom was found to be $4.2\times10^{-3}$.

The photoconductors were incorporated into an image forming apparatus (available from Ricoh Company, Ltd., Japan) illustrated in FIG. 5 (wavelength of writing light: 655 nm, diameter of writing light beam spot: 48 μm, image writing resolution: 1200 dpi, average particle diameter of toner: 7 μm, distance between the photoconductor and the electrostatic charger roller: 20 μm) and thereby yielded an image forming apparatus.

The intermediate transfer belt used herein comprised a non-elastic PVDF rubber.

Uniform halftone images of respective colors were then outputted, and uniform halftone images were obtained.

A colored animation cell was reproduced by the image forming apparatus. Copies with satisfactory image quality were found to be produced when observed with the naked eyes. When the copies were observed through a magnifying glass, a part of the image was found to be missing in a high density image region, but it was trivial in practical use.

The maximum thickness of the toner image formed on the intermediate transfer belt was 34 μm. The partial image missing was significant when the thickness of the toner image formed on the intermediate transfer belt was 30 μm or more.

Example 9

A dispersion was prepared by dispersing 18 parts by weight of carbon black, 3 parts by weight of a dispersing agent, and 400 parts by weight of toluene in 100 parts by weight of a poly(vinylidene fluoride) (PVDF). A cylindrical mold was immersed in the dispersion, was gently drawn up at a rate of 10 mm/sec and was dried at room temperature to form a uniform PVDF film having a thickness of 75 μm thereon. The cylindrical mold bearing the PVDF film having a thickness of 75 μm was again immersed in the same dispersion and was gently drawn up at a rate of 10 mm/sec. This was dried at room temperature to form a PVDF film having a thickness of 150 μm. Another dispersion was prepared by uniformly dispersing 100 parts by weight of a polyurethane prepolymer, 3 parts by weight of a curing agent (isocyanate), 20 parts by weight of carbon black, 3 parts by weight of a dispersing agent, and 500 parts by weight of methyl ethyl ketone. The cylindrical mold bearing the PVDF film having a thickness of 150 μm was then immersed in the above-prepared dispersion and was drawn up at 30 mm/sec. After air-drying, the process was repeated to form a urethane polymer layer having a thickness of 150 μm thereon.

A coating liquid for a surface layer was prepared by uniformly dispersing 100 parts by weight of a polyurethane prepolymer, 3 parts by weight of a curing agent (isocyanate), 50 parts by weight of PTFE (polytetrafluoroethylene) fine particles, 4 parts by weight of a dispersing agent, and 500 parts by weight of methyl ethyl ketone.

The cylindrical mold bearing the urethane prepolymer film having a thickness of 150 μm was immersed in the surface layer coating liquid and was drawn up at 30 mm/sec. After air-drying, the above process was repeated and thereby yielded a urethane surface layer with a thickness of 5 μm in which the PTFE fine particles were uniformly dispersed. After drying at room temperature, this was subjected to crosslinking at 130° C. for 2 hours and thereby yielded an elastic intermediate transfer belt having a three-layer structure consisting of a resin layer (150 μm thick), an elastic layer (150 μm thick), and a surface layer (5 μm thick).

An image forming apparatus was prepared by the procedure of Example 8, except that the above-prepared elastic intermediate transfer belt was used instead of the non-elastic PVDF belt. When the colored animation cell used in Example 8 was reproduced with the image forming apparatus, images with excellent image quality were found to be produced. When the copies in high density image regions were observed through a magnifying glass, no missing images were detected.

As is described above, the present invention has the above configuration and can thereby provide a photoconductor free from image defects such as interference fringes due to multiple reflection of coherent light in the photoconductor and voids or spots due to discharge breakdown. An image forming apparatus and a cartridge for an image forming apparatus using the photoconductor can form high-quality images.

The present invention may be embodied in other specific forms without departing from the spirit or essential characteristics thereof. The present embodiments are therefore to be considered in all respects as illustrative and not restrictive, the scope of the present invention being indicated by the appended claims rather than by the foregoing description, and all the changes which come within the meaning and range of equivalency of the claims are therefore intended to be embraced therein.

What is claimed is:

1. An image forming apparatus comprising:

a photoconductor which comprises a support, and at least a photoconductive layer disposed above the support;

an electrostatic charger for uniformly charging the photoconductor, being arranged at a distance from the photoconductor of 100 μm or less; and a light irradiator for irradiating a coherent light imagewisely to the photoconductor imagewisely, wherein I(S) at a surface of the photoconductor and I(S) at an interface of the photoconductive layer on a side of the support are each $5.0\times10^{-3}$ or less, and wherein a sum of I(S) at the surface of the photoconductor and I(S) at the interface of the photoconductive layer on the side of the support is $3.0\times10^{-3}$ or more, each I(S) being determined by:

subjecting a group of data of N samples of height×(t) [μm] of a profile curve at the surface of the photoconductor or of a profile curve at the interface of the photoconductive layer on the side of the support, to discrete Fourier transform according to following Equation 1, the N samples being taken at intervals of Δt [μm] in a reference line direction; and subjecting the resulting data to calculations according to following Equations 2 and 3, $$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 1}$$

wherein n and m are each an integer; and N is $2^{\rho}$, where ρ is an integer, $$S\left(\frac{n}{N\cdot\Delta t}\right)=\frac{1}{N}\cdot\left|X\left(\frac{n}{N\cdot\Delta t}\right)\right|^2 \quad \text{Equation 2}$$

$$I(S)=\left(\frac{1}{N}\right)\sum_{n=0}^{N-1}\left\{S\left(\frac{n}{N\cdot\Delta t}\right)\right\}. \quad \text{Equation 3}$$

2. An image forming apparatus according to claim 1, wherein Δt is from 0.01 to 50.00 μm and N is 2048 or more.

3. An image forming apparatus according to claim 1, wherein the photoconductor comprises a conductive support and at least a photoconductive layer disposed above the support and particles exposed from the surface of the photoconductor.

4. An image forming apparatus according to claim 3, wherein the particles exposed from the surface of the photoconductor have a primary particle diameter of from 0.01 to 1.0 μm.

5. An image forming apparatus according to claim 3, wherein the particles exposed from the surface of the photoconductor are metallic oxide particles.

6. An image forming apparatus according to claim 5, wherein the particles exposed from the surface of the photoconductor are aluminum oxide particles prepared by a gas phase process.

7. An image forming apparatus according to claim 3, wherein the surface of the photoconductor comprises a polycarbonate resin, a metallic oxide, and a charge transporting material.

8. An image forming apparatus according to claim 1, wherein the support of the photoconductor is one of an unmachined drum and an unmachined belt.

9. An image forming apparatus according to claim 1, wherein the support of the photoconductor is a drum machined with a flat cutting tool.

10. An image forming apparatus according to claim 1, wherein the apparatus is configured to produce an image with a resolution of 1000 dpi or higher.

11. An image forming apparatus according to claim 1, further comprising an applicator configured to apply a lubricant to the surface of the photoconductor.

12. An image forming apparatus according to claim 11, wherein the lubricant is zinc stearate.

13. An image forming apparatus according to claim 1, wherein the coherent light has a wavelength λ of 700 μm or less.

14. An image forming apparatus according to claim 1, wherein the apparatus is configured to output a plurality of writing light beams simultaneously to the photoconductor so as to form images.

15. An image forming apparatus according to claim 1, wherein the apparatus is configured to output a writing light imagewisely to the photoconductor according to a multiple-valued tone reproduction system so as to form an image.

16. An image forming apparatus according to claim 1, wherein the photoconductor further comprises a charge transporting layer having a thickness of 15 μm or less.

17. An image forming apparatus according to claims 1, wherein the apparatus uses a toner having an average particle diameter of 8 μm or less.

18. An image forming apparatus according to claim 17, wherein the apparatus is configured to produce color images.

19. An image forming apparatus according to claim 18, further comprising a plurality of photoconductors for forming a plurality of color toner images, respectively, and an intermediate transfer member to receive color toner images from the respective photoconductors so that the received toner images are superposed to form a color image, and the color image is transfered to an output medium.

20. An image forming apparatus according to claim 19, wherein the intermediate transfer member is an elastic belt.

21. An image forming apparatus according to claim 20, wherein the apparatus is configured so that the color toner image formed on the intermediate transfer belt has a maximum thickness of 30 μm or more.

22. An image forming apparatus according to claim 18, further comprising a plurality of photoconductors for forming a plurality of color toner images, respectively, and an intermediate transfer member to receive the color toner images from respective photoconductors to form stacked color toner images, and to transfer the stacked color toner images from the intermediate transfer member to an image receiving medium.

23. A photoconductor for use in an image forming apparatus, the image forming apparatus comprising:

a photoconductor;

an electrostatic charger for uniformly charging the photoconductor, being arranged at a distance from the photoconductor of 100 μm or less; and a light irradiator for irradiating a coherent light imagewisely to the photoconductor, the photoconductor comprising:

a support, and at least a photoconductive layer disposed above the support;

wherein I(S) at a surface of the photoconductor and I(S) at an interface of the photoconductive layer on a side of the support are each $5.0\times10^{-3}$ or less, and wherein a sum of I(S) at the surface of the photoconductor and I(S) at the interface of the photoconductive layer on the side of the support is $3.0\times10^{-3}$ or more, each I(S) being determined by:

subjecting a group of data of N samples of height×(t) [μm] of a profile curve at the surface of the photoconductor or of a profile curve at the interface of the photoconductive layer on the side of the support, to discrete Fourier transform according to following Equation 4, the N samples being taken at intervals of Δt [μm] in a reference line direction; and subjecting the resulting data to calculations according to following Equations 5 and 6, $$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 4}$$

wherein n and m are each an integer; N is $2^{\rho}$, where ρ is an integer, $$S\left(\frac{n}{N\cdot\Delta t}\right)=\frac{1}{N}\cdot\left|X\left(\frac{n}{N\cdot\Delta t}\right)\right|^2 \quad \text{Equation 5}$$

$$I(S)=\left(\frac{1}{N}\right)\sum_{n=0}^{N-1}\left\{S\left(\frac{n}{N\cdot\Delta t}\right)\right\}. \quad \text{Equation 6}$$

24. A cartridge for an image forming apparatus comprising a photoconductor, the photoconductor comprising:

a support, and at least a photoconductive layer disposed above the support;

wherein I(S) at a surface of the photoconductor and I(S) at an interface of the photoconductive layer on a side of the support are each $5.0\times10^{-3}$ or less, and wherein a sum of I(S) at the surface of the photoconductor and I(S) at the interface of the photoconductive layer on the side of the support is $3.0\times10^{-3}$ or more, each I(S) being determined by:

subjecting a group of data of N samples of height×(t) [μm] of a profile curve at the surface of the photoconductor or of a profile curve at the interface of the photoconductive layer on the side of the support, to discrete Fourier transform according to following Equation 4, the N samples being taken at intervals of Δt [μm] in a reference line direction; and subjecting the resulting data to calculations according to following Equations 5 and 6, $$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right) \quad \text{Equation 4}$$

wherein n and m are each an integer; N is $2^{\rho}$, where ρ is an integer, $$S\left(\frac{n}{N\cdot\Delta t}\right)=\frac{1}{N}\cdot\left|X\left(\frac{n}{N\cdot\Delta t}\right)\right|^2 \quad \text{Equation 5}$$

$$I(S)=\left(\frac{1}{N}\right)\sum_{n=0}^{N-1}\left\{S\left(\frac{n}{N\cdot\Delta t}\right)\right\}, \quad \text{Equation 6}$$

wherein the cartridge is used in an image forming apparatus comprising:

an electrostatic charger for uniformly charging the photoconductor, being arranged at a distance from the photoconductor of 100 μm or less; and a light irradiator for irradiating a coherent light imagewisely to the photoconductor.

* * * * *